US008211607B2

(12) United States Patent
Zhou et al.

(10) Patent No.: US 8,211,607 B2
(45) Date of Patent: Jul. 3, 2012

(54) TONER COMPOSITIONS

(75) Inventors: Ke Zhou, Mississauga (CA); Karen Ann Moffat, Brantford (CA); Edward G. Zwartz, Mississauga (CA); Richard P. N. Veregin, Mississauga (CA); Maria N. V. McDougall, Oakville (CA)

(73) Assignee: Xerox Corporation, Norwalk, CT (US)

( * ) Notice: Subject to any disclaimer, the term of this patent is extended or adjusted under 35 U.S.C. 154(b) by 980 days.

(21) Appl. No.: 12/198,999

(22) Filed: Aug. 27, 2008

(65) Prior Publication Data

US 2010/0055598 A1 Mar. 4, 2010

(51) Int. Cl.
*G03G 9/087* (2006.01)

(52) U.S. Cl. ..... 430/108.4; 430/108.1; 430/109.4; 430/110.2; 430/137.14

(58) Field of Classification Search ..... 430/109.3, 430/109.4, 110.2, 108.4, 108.1, 137.14
See application file for complete search history.

(56) References Cited

U.S. PATENT DOCUMENTS

| | | | | |
|---|---|---|---|---|
| 3,590,000 | A | 6/1971 | Palermiti et al. | |
| 3,800,588 | A | 4/1974 | Larson et al. | |
| 3,847,604 | A | 11/1974 | Hagenbach et al. | |
| 4,295,990 | A | 10/1981 | Verbeek et al. | |
| 4,298,672 | A | 11/1981 | Lu | |
| 4,338,390 | A | 7/1982 | Lu | |
| 4,935,326 | A | 6/1990 | Creatura et al. | |
| 4,937,166 | A | 6/1990 | Creatura et al. | |
| 5,236,629 | A | 8/1993 | Mahabadi et al. | |
| 5,290,654 | A | 3/1994 | Sacripante et al. | |
| 5,302,486 | A | 4/1994 | Patel et al. | |
| 5,330,874 | A | 7/1994 | Mahabadi et al. | |
| 5,346,797 | A | 9/1994 | Kmiecik-Lawrynowicz et al. | |
| 5,364,729 | A | 11/1994 | Kmiecik-Lawrynowicz et al. | |
| 5,403,693 | A | 4/1995 | Patel et al. | |
| 5,418,108 | A | 5/1995 | Kmiecik-Lawrynowicz et al. | |
| 5,501,935 | A | 3/1996 | Patel et al. | |
| 5,527,658 | A | 6/1996 | Hopper et al. | |
| 5,536,771 | A * | 7/1996 | Saito et al. | 524/460 |
| 5,585,215 | A | 12/1996 | Ong et al. | |
| 5,650,255 | A | 7/1997 | Ng et al. | |
| 5,650,256 | A | 7/1997 | Veregin et al. | |
| 5,773,185 | A | 6/1998 | Yachi et al. | |
| 5,853,943 | A | 12/1998 | Cheng et al. | |
| 6,063,827 | A | 5/2000 | Sacripante et al. | |
| 6,214,507 | B1 | 4/2001 | Sokol et al. | |
| 6,395,442 | B1 | 5/2002 | Hayashi et al. | |
| 6,593,049 | B1 | 7/2003 | Veregin et al. | |
| 6,756,176 | B2 | 6/2004 | Stegamat et al. | |
| 6,830,860 | B2 | 12/2004 | Sacripante et al. | |
| 7,214,463 | B2 | 5/2007 | Patel et al. | |
| 7,307,111 | B2 | 12/2007 | Moffat et al. | |
| 7,514,195 | B2 | 4/2009 | Zwartz et al. | |
| 7,846,633 | B2 | 12/2010 | Nakamura et al. | |
| 8,084,180 | B2 | 12/2011 | Zhou et al. | |
| 2005/0287461 | A1 | 12/2005 | Sweeney et al. | |
| 2006/0121383 | A1 * | 6/2006 | Zwartz et al. | 430/109.3 |
| 2006/0216625 | A1 | 9/2006 | Maehata et al. | |
| 2006/0216628 | A1 * | 9/2006 | Nakamura et al. | 430/110.2 |
| 2006/0222991 | A1 | 10/2006 | Sacripante et al. | |
| 2006/0269858 | A1 | 11/2006 | McDougall et al. | |
| 2007/0037086 | A1 | 2/2007 | Skorokhod et al. | |
| 2007/0092821 | A1 | 4/2007 | Sato et al. | |
| 2007/0141496 | A1 * | 6/2007 | Vanbesien et al. | 430/108.8 |
| 2007/0141500 | A1 | 6/2007 | Sugimoto et al. | |
| 2007/0207400 | A1 | 9/2007 | Ahuja et al. | |
| 2007/0254229 | A1 | 11/2007 | Patel et al. | |
| 2008/0193869 | A1 * | 8/2008 | Vanbesien et al. | 430/108.4 |

OTHER PUBLICATIONS

Derwent abstract Acc. No. 1993-060385 describing JP 05-43608 A, published in 1999, copyright 2011.*

* cited by examiner

*Primary Examiner* — Janis L Dote
(74) *Attorney, Agent, or Firm* — MDIP LLC

(57) ABSTRACT

Toner particles are provided which may, in embodiments, include a gel. In embodiments, the toner particles may have a core-shell configuration, with the gel in the core, the shell, or both. The gel may prevent a crystalline resin in the core of the toner particles from migrating to the toner surface.

19 Claims, 5 Drawing Sheets

TONER COMPOSITIONS

CROSS-REFERENCE TO RELATED APPLICATIONS

This application is related to co-pending U.S. application Ser. Nos. 12/198,981 and 12/199,115, both filed on Aug. 27, 2008, the entire disclosures of each of which are hereby incorporated by reference in their entirety.

BACKGROUND

The present disclosure relates to toners suitable for electrophotographic apparatuses.

Numerous processes are within the purview of those skilled in the art for the preparation of toners. Emulsion aggregation (EA) is one such method. These toners may be formed by aggregating a colorant with a latex polymer formed by emulsion polymerization. For example, U.S. Pat. No. 5,853,943, the disclosure of which is hereby incorporated by reference in its entirety, is directed to a semi-continuous emulsion polymerization process for preparing a latex by first forming a seed polymer. Other examples of emulsion/aggregation/coalescing processes for the preparation of toners are illustrated in U.S. Pat. Nos. 5,403,693, 5,418,108, 5,364,729, and 5,346,797, the disclosures of each of which are hereby incorporated by reference in their entirety. Other processes are disclosed in U.S. Pat. Nos. 5,527,658, 5,585,215, 5,650,255, 5,650,256 and 5,501,935, the disclosures of each of which are hereby incorporated by reference in their entirety.

Polyester EA ultra low melt (ULM) toners have been prepared utilizing amorphous and crystalline polyester resins. While these toners may exhibit excellent fusing properties including crease minimum fixing temperature (MFT) and fusing latitude, peak gloss of these toners may be unacceptably high. Moreover, these toilers may exhibit poor charging characteristics, which may be due to the crystalline resin component migrating to the surface during coalescence. Improved toners thus remain desirable.

SUMMARY

The present disclosure provides compositions suitable for making toners as well as processes for producing same. In embodiments, a toner of the present disclosure may include at least one amorphous polyester resin, at least one crystalline polyester resin, and one or more optional ingredients such as colorants, optional waxes, and combinations thereof and a gel including a crosslinked polymer including copolymers of styrene and acrylates, copolymers of styrene and butadiene, copolymers of styrene and methacrylates, copolymers of acrylates and methacrylates, copolymers of methacrylates and acrylic acid, copolymers of acrylates and acrylonitriles, copolymers of methylstyrene and butadiene, copolymers of methacrylates and butadiene, copolymers of acrylates and butadiene, copolymers of styrene and isoprene, copolymers of methylstyrene and isoprene, copolymers of methacrylates and isoprene, copolymers of acrylates and isoprene, and combinations thereof.

In embodiments, a toner of the present disclosure may include at least one amorphous polyester resin, at least one crystalline polyester resin, and one or more optional ingredients such as colorants, optional waxes, and combinations thereof, a gel including a crosslinked polymer including copolymers of styrene and acrylates, copolymers of styrene and butadiene, copolymers of styrene and methacrylates, copolymers of acrylates and methacrylates, copolymers of methacrylates and acrylic acid, copolymers of acrylates and acrylonitriles, copolymers of methylstyrene and butadiene, copolymers of methacrylates and butadiene, copolymers of acrylates and butadiene, copolymers of styrene and isoprene, copolymers of methylstyrene and isoprene, copolymers of methacrylates and isoprene, copolymers of acrylates and isoprene, and combinations thereof, in combination with a stabilizer possessing carboxylic acid functionality derived from a co-monomer of the formula:

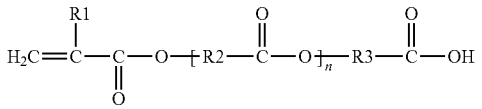

(III)

where R1 is hydrogen or a methyl group; R2 and R3 are independently alkyl groups containing from about 1 to about 12 carbon atoms or a phenyl group; and n is from about 1 to about 10.

A process of the present disclosure may include, in embodiments, contacting at least one amorphous polyester resin with at least one crystalline polyester resin in an emulsion including at least one surfactant; contacting the emulsion with an optional colorant, and an optional wax; contacting the emulsion with a gel including a crosslinked polymer including copolymers of styrene and acrylates, copolymers of styrene and butadiene, copolymers of styrene and methacrylates, copolymers of acrylates and methacrylates, copolymers of methacrylates and acrylic acid, copolymers of acrylates and acrylonitriles, copolymers of methylstyrene and butadiene, copolymers of methacrylates and butadiene, copolymers of acrylates and butadiene, copolymers of styrene and isoprene, copolymers of methylstyrene and isoprene, copolymers of methacrylates and isoprene, copolymers of acrylates and isoprene, and combinations thereof to form small particles; aggregating the small particles to form a plurality of larger aggregates; coalescing the larger aggregates to form particles; and recovering the particles.

BRIEF DESCRIPTION OF THE DRAWINGS

Various embodiments of the present disclosure will be described herein below with reference to the figure wherein:

FIG. 2*a* is for toners having 5% gel in the core compared with those having 5% gel in the shell; FIG. 2*b* is for toners having 2.5% gel in the core compared with those having 2.5% gel in the shell;

FIG. 6*a* is for toners having 5% gel in the core; FIG. 6*b* is for toners having 5% gel in the shell; and FIG. 6*c* is for toners having 2.5% gel in the shell.

DETAILED DESCRIPTION

Figure 1:
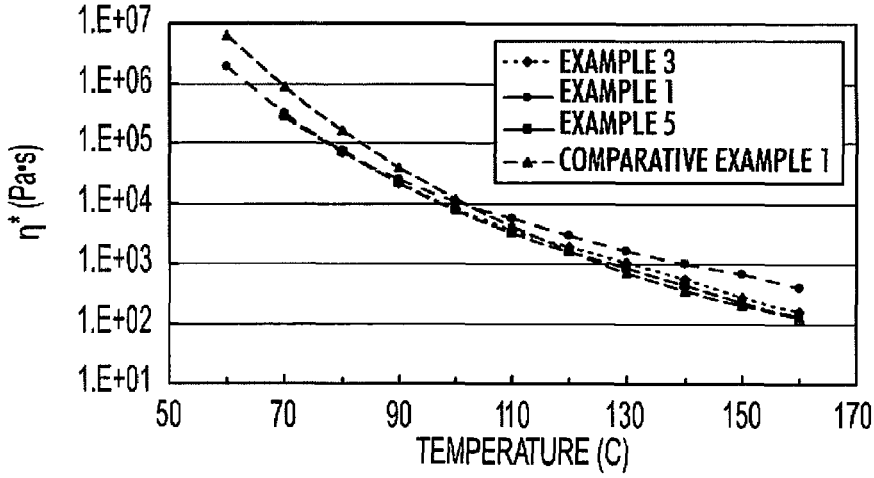
FIG. 1 is a graph comparing the viscosities of toners of the present disclosure, possessing varying amounts of gel in the core, with a control toner.

The present disclosure provides toner particles having desirable charging and gloss properties. The toner particles may possess a core-shell configuration, with a gel or partially crosslinked resin in the core, shell, or both.

Core Resins

In embodiments, the polymer utilized to form the resin core may be a polyester resin, including the resins described in U.S. Pat. Nos. 6,593,049 and 6,756,176, the disclosures of each of which are hereby incorporated by reference in their entirety. Suitable resins may also include a mixture of an amorphous polyester resin and a crystalline polyester resin as described in U.S. Pat. No. 6,830,860, the disclosure of which is hereby incorporated by reference in its entirety.

In embodiments, the resin may be a polyester resin formed by reacting a diol with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol may be, for example, selected in an amount of from about 40 to about 60 mole percent, in embodiments from about 42 to about 55 mole percent, in embodiments from about 45 to about 53 mole percent, and the alkali sulfo-aliphatic diol can be selected in an amount of from about 0 to about 10 mole percent, in embodiments from about 1 to about 4 mole percent of the resin.

Examples of organic diacids or diesters selected for the preparation of the crystalline resins include oxalic acid, succinic acid, glutaric acid, adipic acid, suberic acid, azelaic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof; and an alkali sulfo-organic diacid such as the sodio lithio or potassio salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methylpentanediol, 2-sulfo-3,3-dimethylpentanediol, sulfo-p-hydroxybenzoic acid, N,N-bis(2-hydroxyethyl)-2-amino ethane sulfonate, or mixtures thereof. The organic diacid may be selected in an amount of, for example, in embodiments from about 40 to about 60 mole percent, in embodiments from about 42 to about 52 mole percent, in embodiments from about 45 to about 50 mole percent, and the alkali sulfo-aliphatic diacid can be selected in an amount of from about 1 to about 10 mole percent of the resin.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), alkali copoly(5-sulfoisophthaloyl)-copoly(ethylene-adipate), alkali copoly(5-sulfoisophthaloyl)-copoly(propylene-adipate), alkali copoly(5-sulfoisophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfoisophthaloyl)-copoly(ethylene-succinate), alkali copoly(5-sulfoisophthaloyl)-copoly(propylene-succinate), alkali copoly(5-sulfoisophthaloyl)-copoly(butylenes-succinate), alkali copoly(5-sulfoisophthaloyl)-copoly(pentylene-succinate), alkali copoly(5-sulfoisophthaloyl)-copoly(hexylene-succinate), alkali copoly(5-sulfoisophthaloyl)-copoly(octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly(hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), poly(octylene-adipate), wherein alkali is a metal like sodium, lithium or potassium. Examples of polyamides include poly(ethylene-adipamide), poly(propylene-adipamide), poly(butylenes-adipamide), poly(pentylene-adipamide), poly(hexylene-adipamide), poly(octylene-adipamide), poly(ethylene-succinamide), and poly(propylene-sebecamide). Examples of polyimides include poly(ethylene-adipimide), poly(propylene-adipimide), poly(butylene-adipimide), poly(pentylene-adipimide), poly(hexylene-adipimide), poly(octylene-adipimide), poly(ethylene-succinimide), poly(propylene-succinimide), and poly(butylene-succinimide).

The crystalline resin may be present, for example, in an amount of from about 5 to about 50 percent by weight of the toner components, in embodiments from about 5 to about 35 percent by weight of the toner components. The crystalline resin can possess various melting points of, for example, from about 30° C. to about 120° C. in embodiments from about 50° C. to about 90° C. The crystalline resin may have a number average molecular weight ($M_n$), as measured by gel permeation chromatography (GPC) of for example, from about 1,000 to about 50,000, in embodiments from about 2,000 to about 25,000, and a weight average molecular weight ($M_w$) of, for example, from about 2,000 to about 100,000, in embodiments from about 3,000 to about 80,000, as determined by Gel Permeation Chromatography using polystyrene standards. The molecular weight distribution ($M_w/M_n$) of the crystalline resin may be, for example, from about 2 to about 6, in embodiments from about 2 to about 4.

Examples of diacid or diesters selected for the preparation of amorphous polyesters include dicarboxylic acids or diesters such as terephthalic acid, phthalic acid, isophthalic acid, fumaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mole percent of the resin, in embodiments from about 42 to about 52 mole percent of the resin, in embodiments from about 45 to about 50 mole percent of the resin.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl) oxide, dipropylene glycol, dibutylene, and combinations thereof. The amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin.

Polycondensation catalysts which may be utilized for either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin.

In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be utilized include poly(styrene-acrylate) resins, crosslinked, for example, from about 10 percent to about 70 percent, poly(styrene-acrylate) resins, poly(styrene-methacrylate) resins, crosslinked poly(styrene-methacrylate) resins, poly(styrene-butadiene) resins, crosslinked poly(styrene-butadiene) resins, alkali sulfonated-polyester resins, branched alkali sulfonated-polyester resins, alkali sulfonated-polyimide resins, branched alkali sulfonated-polyimide resins, alkali sulfonated poly(styrene-acrylate) resins, crosslinked alkali sulfonated poly(styrene-acrylate) resins, poly(styrene-methacrylate) resins, crosslinked alkali sulfonated-poly(styrene-methacrylate) resins, alkali sulfonated-poly(styrene-butadiene) resins, and crosslinked alkali sulfonated poly(styrene-butadiene) resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfo-isophthalate), copoly(propylene-butylene-terephthalate)-copoly(propylene-butylene-5-sulfo-isophthalate), copoly(propoxylated bisphenol-A-fumarate)-copoly(propoxylated bisphenol A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), and wherein the alkali metal is, for example, a sodium, lithium or potassium ion.

In embodiments, an unsaturated polyester resin may be utilized as a latex resin. Examples of such resins include those disclosed in U.S. Pat. No. 6,063,827, the disclosure of which is hereby incorporated by reference in its entirety. Exemplary unsaturated polyester resins include, but are not limited to poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

In embodiments, a suitable polyester resin may be a poly(propoxylated bisphenol A co-fumarate) resin having the following formula (I):

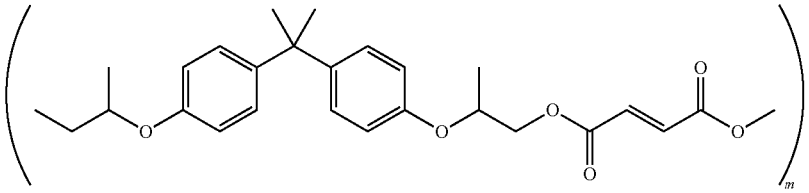

(I)

wherein m may be from about 5 to about 1000.

An example of a linear propoxylated bisphenol A fumarate resin which may be utilized as a latex resin is available under the trade name SPARI™ from Resana S/A Industrias Quimicas, Sao Paulo Brazil. Other propoxylated bisphenol A fumarate resins that may be utilized and are commercially available include GTUF™ and FPESL2™ from Kao Corporation, Japan, and EM18163™ from Reichhold, Research Triangle Park, North Carolina and the like.

Suitable crystalline resins include those disclosed in U.S. Patent Application Publication No. 2006/0222991, the disclosure of which is hereby incorporated by reference in its entirety. In embodiments, a suitable crystalline resin may include a resin composed of ethylene glycol and a mixture of dodecanedioic acid and fumaric acid co-monomers with the following formula:

(II)

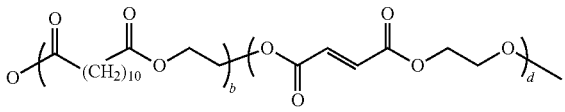

wherein b is from 5 to 2000 and d is from 5 to 2000.

For example, in embodiments, a poly(propoxylated bisphenol A co-fumarate) resin of formula I as described above may be combined with a crystalline resin of formula II to form a core.

In embodiments, the amorphous resin or combination of amorphous resins utilized in the core may have a glass transition temperature of from about 30° C. to about 80° C., in embodiments from about 35° C. to about 70° C. In further embodiments, the combined resins utilized in the core may have a melt viscosity of from about 10 to about 1,000,000 Pa*S at about 130° C., in embodiments from about 50 to about 100,000 Pa*S.

One, two, or more toner resins may be used. In embodiments where two or more toner resins are used, the toner resins may be in any suitable ratio (e.g., weight ratio) such as for instance about 10% (first resin)/90% (second resin) to about 90% (first resin)/10% (second resin).

In embodiments, the resin may be formed by condensation polymerization methods.

Gel

In embodiments, the core resins described above may be combined with a gel latex. A "gel latex" may include, in embodiments, for example, a crosslinked resin or polymer, or mixtures thereof, or a non-crosslinked resin that has been subjected to crosslinking. In accordance with the present disclosure, from about 1% by weight to about 100% by weight of the gel may be crosslinked, in embodiments from about 5% by weight to about 50% by weight of the gel may be crosslinked.

Suitable crosslinked resins which may be added to the core resin include, but are not limited to, copolymers of styrene and acrylates, copolymers of styrene and butadiene, copolymers of styrene and methacrylates, copolymers of acrylates and methacrylates, copolymers of methacrylates and acrylic acid, copolymers of acrylates and acrylonitriles, copolymers of methylstyrene and butadiene, copolymers of methacrylates and butadiene, copolymers of acrylates and butadiene, copolymers of styrene and isoprene, copolymers of methylstyrene and isoprene, copolymers of methacrylates and isoprene, copolymers of acrylates and isoprene, and combinations of any of the foregoing monomers with additional monomers and/or combinations thereof.

In embodiments, the crosslinked resin may include, for example, poly(styrene-co-alkyl acrylate), poly(styrene-co-butadiene), poly(styrene-co-alkyl methacrylate), poly(styrene-co-alkyl acrylate-co-acrylic acid), poly(styrene-co-1,3-butadiene-co-acrylic acid), poly(styrene-co-alkyl methacrylate-co-acrylic acid), poly(alkyl methacrylate-co-alkyl acrylate), poly(alkyl methacrylate-co-aryl acrylate), poly(aryl methacrylate-co-alkyl acrylate), poly(alkyl methacrylate-co-acrylic acid), poly(styrene-co-alkyl acrylate-co-acrylonitrile-acrylic acid), poly(styrene-co-butadiene-co-acrylonitrile-co-acrylic acid), poly(alkyl acrylate-co-acrylonitrile-co-acrylic acid), poly(methylstyrene-co-butadiene), poly(methyl methacrylate-co-butadiene), poly(ethyl methacrylate-co-butadiene), poly(propyl methacrylate-co-butadiene), poly(butyl methacrylate-co-butadiene), poly(methyl acrylate-co-butadiene), poly(ethyl acrylate-co-butadiene), poly(propyl acrylate-co-butadiene), poly(butyl acrylate-co-butadiene), poly(styrene-co-isoprene), poly(methylstyrene-co-isoprene), poly(methyl methacrylate-co-isoprene), poly(ethyl methacrylate-co-isoprene), poly(propyl methacrylate-co-isoprene), poly(butyl methacrylate-co-isoprene), poly(methyl acrylate-co-isoprene), poly(ethyl acrylate-co-isoprene), poly(propyl acrylate-co-isoprene), poly(butyl acrylate-co-isoprene), poly(styrene-co-propyl acrylate), poly(styrene-co-butyl acrylate), poly(styrene-co-butadiene-co-methacrylic acid), poly(styrene-co-butyl acrylate-co-acrylic acid), poly(styrene-co-butyl acrylate-co-methacrylic acid), poly(styrene-co-butyl acrylate-co-acrylonitrile), poly(styrene-co-butyl acrylate-co-acrylonitrile-acrylic acid), poly(styrene-co-butyl methacrylate), poly(styrene-co-butyl methacrylate-co-acrylic acid), poly(butyl methacrylate-co-butyl acrylate), poly(butyl methacrylate-co-acrylic acid), poly(acrylonitrile-co-butyl acrylate-co-acrylic acid), and mixtures and combinations thereof. The polymers may be block, random, grafting, or alternating copolymers.

In embodiments initiators may be added to the monomers making up the gel in order to enhance formation of the gel latex. Examples of suitable initiators include water soluble initiators, such as ammonium per-sulfate, sodium persulfate and potassium persulfate, and organic soluble initiators including organic peroxides and azo compounds including Vazo peroxides, such as VAZO 64™, 2-methyl 2-2'-azobis propanenitrile. VAZO 88™, 2-2'-azobis isobutyramide dehydrate, and mixtures thereof. Other water-soluble initiators which may be utilized include azoamidine compounds, for example 2, 2'-azobis(2-methyl-N-phenylpropionamidine) dihydrochloride, 2,2'-azobis[N-(4-chlorophenyl)-2-methyl-propionamidine]di-hydrochloride, 2,2'-azobis[N-(4-hydroxyphenyl)-2-methyl-propionamidine]dihydrochloride, 2,2'-azobis[N-(4-amino-phenyl)-2-methylpropionamidine] tetrahydrochloride, 2,2'-azobis[2-methyl-N(phenylmethyl) propionamidine]dihydrochloride, 2,2'-azobis[2-methyl-N-2-propenylpropionamidine]dihydrochloride, 2,2'-azobis[N-(2-hydroxy-ethyl)-2-methylpropionamidine]dihydrochloride, 2,2'-azobis[2(5-methyl-2-imidazolin-2-yl)propane]dihydrochloride, 2,2'-azobis[2-(2-imidazolin-2-yl)propane]dihydrochloride, 2,2'-azobis[2-(4,5,6,7-tetrahydro-1H-1,3-diazepin-2-yl)propane]dihydrochloride, 2,2'-azobis[2-(3,4,5,6-tetrahydropyrimidin-2-yl)propane]dihydrochloride, 2,2'-azobis[2-(5-hydroxy-3,4,5,6-tetrahydropyrimidin-2-yl) propane]dihydrochloride, 2,2'-azobis {2-[1-(2-hydroxyethyl)-2-imidazolin-2-yl]propane}dihydrochloride, combinations thereof, and the like.

Initiators can be added in suitable amounts, such as from about 0.1 to about 8 weight percent of the monomers utilized to form the gel latex, in embodiments of from about 0.2 to about 5 weight percent of the monomers utilized to form the gel latex.

In embodiments, chain transfer agents may also be used in forming the gel latex. Suitable chain transfer agents include, but are not limited to dodecane thiol, octane thiol, carbon tetrabromide, combinations thereof, and the like, in amounts from about 0.05 to about 10 percent by weight of the monomers utilized to form the gel latex and, in embodiments, from about 0.1 to about 5 percent by weight of monomers utilized to form the gel latex, to control the molecular weight properties of the gel when emulsion polymerization is conducted in accordance with the present disclosure.

In embodiments, a crosslinker, such as divinyl aromatic or divinyl acrylate or methacrylate monomers, or diacrylic or dimethacrylic monomers, may be used to form the crosslinked resin. Exemplary crosslinkers include, but are not limited to, divinyl benzene, dodecane diacrylate, 1,4-butane diacrylate, divinyl naphthalene, ethylene glycol diacrylate, 1,3-butylene-glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, polyethylene-glycol 400 diacrylate (400 being the molecular weight of the polyethylene glycol), polyethylene-glycol 600 diacrylate (600 being the molecular weight of the polyethylene glycol), dipropylene glycol diacrylate, combinations thereof, and the like. The crosslinker may be present in an amount of from about 0.01 percent by weight to about 25 percent by weight of the crosslinked resin, and in embodiments of from about 0.5 to about 15 percent by weight of the crosslinked resin.

In embodiments, a gel latex may be formed as described in U.S. Pat. No. 7,307,111 and U.S. Patent Application Publication Nos. 2007/0207400, 2007/0037086, and 2006/0269858, the disclosures of each of which are hereby incorporated by reference in their entirety.

The gel latex may include, for example, submicron crosslinked resin particles having a size of, for example, from about 10 nanometers to about 200 nanometers in volume average diameter, in embodiments of from about 20 nanometers to 100 nanometers in volume average diameter. The gel latex may be suspended in an aqueous phase of water containing a surfactant, including any surfactant described above. The surfactant may be present in an amount from about 0.5 to about 5 percent by weight of the solids, and in embodiments from about 0.7 to about 2 percent by weight of the solids.

In embodiments, it may be advantageous to include a stabilizer when forming the gel latex. Suitable stabilizers include monomers having carboxylic acid functionality. In embodiments, suitable stabilizers may be derived from a comonomer of the following formula (III):

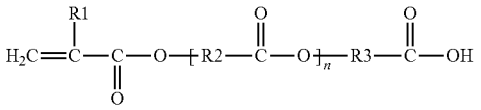

(III)

where R1 is hydrogen or a methyl group; R2 and R3 are independently selected from alkyl groups containing from about 1 to about 12 carbon atoms or an aryl group containing from about 6 to about 24 carbon atoms such as phenyl group; and n is from about 0 to about 20, in embodiments from about 1 to about 10. Examples of such stabilizers include beta carboxyethyl acrylate (sometimes referred to herein as poly(2-carboxyethyl)acrylate) (β-CEA), poly(2-carboxyethyl) acrylate, 2-carboxyethyl methacrylate, combinations thereof, and the like.

While not wishing to be bound by any theory, in embodiments the carboxylic acid groups from the stabilizer, which may be found throughout the polymer chain, may increase the compatibility of the gel latex with the amorphous polyester resin. For example, the gel latex may have an acid value of from about 2 to about 100 mg KOH/gram resin, in embodiments from about 5 to about 25 mg KOH/gram resin, which is similar to the acid value of the amorphous polyester resin, which may be from about 8 to about 18 mg KOH/gram resin In embodiments, the stabilizer having carboxylic acid functionality may also contain metallic ions, such as sodium, potassium and/or calcium, to achieve better emulsion polymerization results. The metallic ions may be present in an amount from about 0.001 to about 10 percent by weight of the stabilizer having carboxylic acid functionality, in embodiments from about 0.5 to about 5 percent by weight of the stabilizer having carboxylic acid functionality.

It may be desirable, in embodiments, to include an acrylate such as a beta-carboxyethyl acrylate (β-CEA) in forming the gel latex. The glass transition temperature of this the resulting latex may be from about 30° C. to about 80° C., in embodiments from about 40° C. to about 65° C.

The resulting gel may thus possess a carboxylic acid group or a carboxylic acid salt group.

Where utilized, the stabilizer may be present in the gel in an amount of from about 0.5% to about 10% by weight of the other components (for example, monomers) of the gel, in embodiments from about 5% to about 8% by weight of the other components of the gel.

The amount of gel in a toner particle of the present disclosure, whether in the core, the shell, or both, may be from about 1% to about 30% by weight of the toner, in embodiments from about 2.5% to about 10% by weight, or from about 4% to about 9% by weight of the toner.

Toner

The resin described above may be utilized to form toner compositions. Such toner compositions may include optional colorants, waxes, and other additives. Toners may be formed utilizing any method within the purview of those skilled in the art.

Surfactants

In embodiments, colorants, waxes, and other additives utilized to form toner compositions may be in dispersions including surfactants. Moreover, toner particles may be formed by emulsion aggregation methods where the resin and other components of the toner are placed in one or more surfactants, an emulsion is formed, toner particles are aggregated, coalesced, optionally washed and dried, and recovered.

One, two, or more surfactants may be utilized. The surfactants may be selected from ionic surfactants and nonionic surfactants. Anionic surfactants and cationic surfactants are encompassed by the term "ionic surfactants." In embodiments, the surfactant may be utilized so that it is present in an amount of from about 0.01% to about 5% by weight of the toner composition, for example from about 0.75% to about 4% by weight of the toner composition, in embodiments from about 1% to about 3% by weight of the toner composition.

Examples of nonionic surfactants that can be utilized include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy)ethanol, available from Rhone-Poulenc as IGEPAL CA-210™, IGEPAL CA-520™, IGEPAL CA-720™, IGEPAL Co-890™, IGEPAL CO-720™, IGEPAL CO-290™, IGEPAL CA-210™, ANTAROX 890™ and ANTAROX 897™. Other examples of suitable nonionic surfactants include a block copolymer of polyethylene oxide and polypropylene oxide, including those commercially available as SYNPERONIC PE/F, in embodiments SYNPERONIC PE/F 108.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, and acids such as abitic acid, which may be obtained from Aldrich, or NEOGEN R™, NEOGEN SC™, NEOGEN RK™ which may be obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride. MIRAPOL™ and ALKAQUAT™, available from Alkaril Chemical Company, SANIZOL™ (benzalkonium chloride), available from Kao Chemicals, and the like, and mixtures thereof.

Colorants

As the colorant to be added, various known suitable colorants, such as dyes, pigments, mixtures of dyes, mixtures of pigments, mixtures of dyes and pigments, and the like, may be included in the toner. The colorant may be included in the toner in an amount of, for example, about 0.1 to about 35 percent by weight of the toner, or from about 1 to about 15 weight percent of the toner, or from about 3 to about 10 percent by weight of the toner.

As examples of suitable colorants, mention may be made of carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CBS600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof are used. The pigment or pigments are generally used as water based pigment dispersions.

Specific examples of pigments include SUNSPERSE 6000. FLEXIVERSE and AQUATONE water based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET I™. PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF). Sudan Blue OS (BASF), PV Fast Blue B2G01 (American Hoechst), Sunsperse Blue BHD 6000 (Sun Chemicals). Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF). Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing, and the like.

Wax

Optionally, a wax may also be combined with the resin and a colorant in forming toner particles. When included, the wax may be present in an amount of, for example, from about 1 weight percent to about 25 weight percent of the toner particles, in embodiments from about 5 weight percent to about 20 weight percent of the toner particles.

Waxes that may be selected include waxes having, for example, a weight average molecular weight of from about 500 to about 20,000, in embodiments from about 1,000 to about 10,000. Waxes that may be used include, for example, polyolefins such as polyethylene, polypropylene, and polybutene waxes such as commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostcarate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™. SUPERSLIP 6530™ available from Micro Powder Inc., fluorinated waxes, for example POLYFLUO 190™, POLYFLUO 200™ POLYSILK 19™, POLYSILK 14™ available from Micro Powder Inc., mixed fluorinated, amide waxes, for example MICROSPERSION 19™ also available from Micro Powder Inc. imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents.

Toner Preparation

The toner particles may be prepared by any method within the purview of one skilled in the art. Although embodiments relating to toner particle production are described below with respect to emulsion-aggregation processes, any suitable method of preparing toner particles may be used, including chemical processes, such as suspension and encapsulation processes disclosed in U.S. Pat. Nos. 5,290,654 and 5,302,486, the disclosures of each of which are hereby incorporated by reference in their entirety. In embodiments, toner compositions and toner particles may be prepared by aggregation and coalescence processes in which small-size resin particles are aggregated to the appropriate toner particle size and then coalesced to achieve the final toner-particle shape and morphology.

In embodiments, toner compositions may be prepared by emulsion-aggregation processes, such as a process that includes aggregating a mixture of an optional colorant, an optional wax and any other desired or required additives, and emulsions including the resins and/or gels described above, optionally in surfactants as described above, and then coalescing the aggregate mixture. A mixture may be prepared by adding a colorant and optionally a wax or other materials, which may also be optionally in a dispersion(s) including a surfactant, to the emulsion, which may be a mixture of two or more emulsions containing the resin. The pH of the resulting mixture may be adjusted by an acid such as, for example, acetic acid, nitric acid or the like. In embodiments, the pH of the mixture may be adjusted to from about 2 to about 5. Additionally, in embodiments, the mixture may be homogenized. If the mixture is homogenized, homogenization may be accomplished by mixing at about 600 to about 6,000 revolutions per minute. Homogenization may be accomplished by any suitable means, including, for example, an IKA ULTRA TURRAX®T50 probe homogenizer.

Following the preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

The aggregating agent may be added to the mixture utilized to form a toner in an amount of, for example, from about 0.1% to about 10% by weight, in embodiments from about 0.2% to about 8% by weight, in other embodiments from about 0.5% to about 5% by weight, of the resin in the mixture. This should provide a sufficient amount of agent for aggregation.

The particles may be permitted to aggregate until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example with a COULTER COUNTER®, for average particle size. The aggregation thus may proceed by maintaining the elevated temperature, or slowly raising the temperature to, for example, from about 40° C. to about 100° C., and holding the mixture at this temperature for a time of from about 0.5 hours to about 6 hours, in embodiments from about hour 1 to about 5 hours, while maintaining stirring, to provide the aggregated particles. Once the predetermined desired particle size is reached, then the growth process is halted.

The growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example of from about 40° C. to about 90° C., in embodiments from about 45° C. to about 80° C., which may be below the glass transition temperature of the resin as discussed above.

Once the desired final size of the toner particles is achieved, the pH of the mixture may be adjusted with a base to a value of from about 3 to about 10, and in embodiments from about 5 to about 9. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, ethylene diamine tetraacetic acid (EDTA) may be added to help adjust the pH to the desired values noted above.

Shell Resin

In embodiments, after aggregation, but prior to coalescence, a resin coating may be applied to the aggregated particles to form a shell thereover. Any resin described above as suitable for forming the core resin may be utilized as the shell. In embodiments, a gel latex as described above may be included in the shell. In yet other embodiments, the gel latex described above may be combined with a resin that may be utilized to form the core, and then added to the particles as a resin coating to form a shell.

In embodiments, resins which may be utilized to form a shell include, but are not limited to a gel latex described above, and/or the amorphous resins described above for use as the core. In embodiments, an amorphous resin which may be utilized to form a shell in accordance with the present disclosure includes an amorphous polyester, optionally in combination with a gel latex described above. For example, in embodiments, an amorphous resin of formula I above may be combined with a crosslinked styrene-n-butyl acrylate resin to form a gel shell. Multiple resins may be utilized in any suitable amounts. In embodiments, a first amorphous polyester resin, for example an amorphous resin of formula I above, may be present in an amount of from about 20 percent by weight to about 100 percent by weight of the total shell resin, in embodiments from about 30 percent by weight to about 90 percent by weight of the total shell resin. Thus, in embodiments, a second resin may be present in the shell resin in an amount of from about 0 percent by weight to about 80 percent by weight of the total shell resin, in embodiments from about 10 percent by weight to about 70 percent by weight of the shell resin.

The shell resin may be applied to the aggregated particles by any method within the purview of those skilled in the art. In embodiments, the resins utilized to form the shell may be in an emulsion including any surfactant described above. The emulsion possessing the resins, optionally the gel latex described above, may be combined with the aggregated particles described above so that the shell forms over the aggregated particles.

The formation of the shell over the aggregated particles may occur while heating to a temperature of from about 30° C. to about 80° C., in embodiments from about 35° C. to about 70° C. The formation of the shell may take place for a period of time of from about 5 minutes to about 10 hours, in embodiments from about 10 minutes to about hours.

Coalescence

Following aggregation to the desired particle size and application of any optional shell, the particles may then be coalesced to the desired final shape, the coalescence being achieved by, for example, heating the mixture to a temperature of from about 45° C. to about 100° C., in embodiments from about 55° C. to about 99° C., which may be at or above the glass transition temperature of the resins utilized to form the toner particles, and/or reducing the stirring, for example to from about 100 rpm to about 1,000 rpm, in embodiments from about 200 rpm to about 800 rpm. Higher or lower temperatures may be used, it being understood that the temperature is a function of the resins used for the binder. Coalescence may be accomplished over a period of from about 0.01 to about 9 hours, in embodiments from about 0.1 to about 4 hours.

After aggregation and/or coalescence, the mixture may be cooled to room temperature, such as from about 20° C. to about 25° C. The cooling may be rapid or slow, as desired. A suitable cooling method may include introducing cold water to a jacket around the reactor. After cooling, the toner particles may be optionally washed with water, and then dried. Drying may be accomplished by any suitable method for drying including, for example, freeze-drying.

In embodiments, a gel in a shell resin may be able to prevent any crystalline resin in the core from migrating to the toner surface. In addition, the resins in the shell may be less compatible with the crystalline resin utilized in forming the core, which may result in a higher toner glass transition temperature (Tg), and thus improved blocking and charging characteristics may be obtained, including A-zone charging. Moreover, toners of the present disclosure having a gel latex in the core and/or shell may exhibit excellent document offset performance characteristics, as well as reduced peak gloss, in embodiments from about 20 Gardner gloss units (ggu) to about 100 ggu, in other embodiments from about 40 ggu to about 80 ggu, which may be desirable for reproduction of text and images, as some users object to high gloss and the differential which may occur between low gloss and high gloss.

Where the core, the shell, or both includes a gel latex as described above, the presence of the gel latex may prevent the crystalline resin in the core from migrating to the toner surface. This may especially occur where the gel latex is present in the shell. In addition, the shell resin(s) may be less compatible with the crystalline resin utilized in forming the core, which may result in a higher toner glass transition temperature (Tg), and thus improved blocking and charging characteristics may be obtained, including A-zone charging. In addition, the gel utilized in the formation of a core-shell particle may have a high viscosity of greater than about 10,000,000 Poise, in embodiments greater than about 50,000,000 Poise, at coalescence temperature, for example from about 60° C. to about 90° C., in embodiments from about 65° C. to about 80° C., which may be able to prevent crystalline resin in the core from migrating to the toner surface and thus improve A-zone charging.

In embodiments, the gel utilized in forming the core and/or shell may be present in an amount of from about 2 percent by weight to about 40 percent by weight of the dry toner particles, in embodiments from about 2.5 percent by weight to about 20 percent by weight of the dry toner particles.

Toner particles possessing a core and or shell possessing a gel latex as described above may have a glass transition temperature of from about 30° C. to about 80° C., in embodiments from about 35° C. to about 70° C.

Additives

In embodiments, the toner particles may also contain other optional additives, as desired or required. For example, the toner may include positive or negative charge control agents, for example in an amount of from about 0.1 to about 10 percent by weight of the toner, in embodiments from about 1 to about 3 percent by weight of the toner. Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in its entirety; organic sulfate and sulfonate compositions, including those disclosed in U.S. Pat. No. 4,338,390, the disclosure of which is hereby incorporated by reference in its entirety; cetyl pyridinium tetrafluoroborates; distearyl dimethyl ammonium methyl sulfate; aluminum salts such as BONTRON E84™ or E88™ (Hodogaya Chemical); combinations thereof, and the like. Such charge control agents may be applied simultaneously with the shell resin described above or after application of the shell resin.

There can also be blended with the toner particles external additive particles including flow aid additives, which additives may be present on the surface of the toner particles. Examples of these additives include metal oxides such as titanium oxide, silicon oxide, tin oxide, mixtures thereof and the like; colloidal and amorphous silicas, such as AEROSIL®, metal salts and metal salts of fatty acids inclusive of zinc stearate, aluminum oxides, cerium oxides, and mixtures thereof. Each of these external additives may be present in an amount of from about 0.1 percent by weight to about 5 percent by weight of the toner, in embodiments of from about 0.25 percent by weight to about 3 percent by weight of the toner. Suitable additives include those disclosed in U.S. Pat. Nos. 3,590,000, 3,800,588, and 6,214,507, the disclosures of each of which are hereby incorporated by reference in their entirety. Again, these additives may be applied simultaneously with the shell resin described above or after application of the shell resin.

In embodiments, toners of the present disclosure may be utilized as ultra low melt (ULM) toners. In embodiments, the dry toner particles having a core and/or shell including the gel of the present disclosure may, exclusive of external surface additives, have the following characteristics:

(1) Volume average diameter (also referred to as "volume average particle diameter") of from about 3 to about 25 μm, in embodiments from about 4 to about 15 μm, in other embodiments from about 5 to about 12 μm.

(2) Number Average Geometric Size Distribution (GSDn) and/or Volume Average Geometric Size Distribution (GSDv) of from about 1.05 to about 1.55, in embodiments from about 1.1 to about 1.4.

(3) Circularity of from about 0.9 to about 1, in embodiments from about 0.93 to about 0.98 (measured with, for example, a Sysmex FPIA® 2100 analyzer).

The characteristics of the toner particles may be determined by any suitable technique and apparatus. Volume average particle diameter $D_{50v}$, GSDv, and GSDn may be measured by means of a measuring instrument such as a Beckman MULTISIZER™ 3 COULTER COUNTER®, operated in accordance with the manufacturer's instructions.

Representative sampling may occur as follows: a small amount of toner sample, about 1 gram, may be obtained and filtered through a 25 micrometer screen, then put in isotonic solution to obtain a concentration of about 10%, with the sample then run in a Beckman MULTISIZER™ 3 COULTER COUNTER®.

Toners produced in accordance with the present disclosure may possess excellent charging characteristics when exposed to extreme relative humidity (RH) conditions. The low-humidity zone (C zone) may be about 10° C./15% RH, while the high humidity zone (A zone) may be about 28° C./85% RH. Toners of the present disclosure may possess a parent toner charge per mass ratio (Q/M) of from about −3 μC/g to about −35 μC/g, in embodiments from about −4 μC/g to about −30 μC/g, and a final toner charging after surface additive blending of from −10 μC/g to about −45 μC/g, in embodiments from about −12 μC/g to about −40 μC/g.

Developers

The toner particles may be formulated into a developer composition. The toner particles may be mixed with carrier particles to achieve a two-component developer composition. The toner concentration in the developer may be from about 1% to about 25% by weight of the total weight of the developer, in embodiments from about 2% to about 15% by weight of the total weight of the developer.

Carriers

Examples of carrier particles that can be utilized for mixing with the toner include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Other carriers include those disclosed in U.S. Pat. Nos. 3,847,604, 4,937,166, and 4,935,326.

The selected carrier particles can be used with or without a coating. In embodiments, the carrier particles may include a core with a coating thereover which may be formed from a mixture of polymers that are not in close proximity thereto in the triboelectric series. The coating may include fluoropolymers, such as polyvinylidene fluoride resins, terpolymers of styrene, methyl methacrylate, and/or silanes, such as triethoxy silane, tetrafluoroethylenes, other known coatings and the like. For example, coatings containing polyvinylidenefluoride, available, for example, as KYNAR 301F™, and/or polymethylmethacrylate, for example having a weight average molecular weight of about 300,000 to about 350,000, such as commercially available from Soken, may be used. In embodiments, polyvinylidenefluoride and polymethylmethacrylate (PMMA) may be mixed in proportions of from about 30 to about 70 weight % to about 70 to about 30 weight %, in embodiments from about 40 to about 60 weight % to about 60 to about 40 weight %. The coating may have a coating weight of, for example, from about 0.1 to about 5% by weight of the carrier, in embodiments from about 0.5 to about 2% by weight of the carrier.

In embodiments, PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with polymer in an amount from about 0.05 to about 10 percent by weight, in embodiments from about 0.01 percent to about 3 percent by weight, based on the weight of the coated carrier particles, until adherence thereof to the carrier core by mechanical impaction and/or electrostatic attraction.

Various effective suitable means can be used to apply the polymer to the surface of the carrier core particles, for example, cascade roll mixing, tumbling, milling, shaking, electrostatic powder cloud spraying, fluidized bed, electrostatic disc processing, electrostatic curtain, combinations thereof; and the like. The mixture of carrier core particles and polymer may then be heated to enable the polymer to melt and fuse to the carrier core particles. The coated carrier particles may then be cooled and thereafter classified to a desired particle size.

In embodiments, suitable carriers may include a steel core, for example of from about 25 to about 100 μm in size, in embodiments from about 50 to about 75 μm in size, coated with about 0.5% to about 10% by weight, in embodiments from about 0.7% to about 5% by weight, of a conductive polymer mixture including, for example, methylacrylate and carbon black using the process described in U.S. Pat. Nos. 5,236,629 and 5,330,874.

The carrier particles can be mixed with the toner particles in various suitable combinations. The concentrations are may be from about 1% to about 20% by weight of the toner composition. However, different toner and carrier percentages may be used to achieve a developer composition with desired characteristics.

Imaging

The toners can be utilized for electrostatographic or xerographic processes, including those disclosed in U.S. Pat. No. 4,295,990, the disclosure of which is hereby incorporated by reference in its entirety. In embodiments, any known type of image development system may be used in an image developing device, including, for example, magnetic brush development, jumping single-component development, hybrid scavengeless development (HSD), and the like. These and similar development systems are within the purview of those skilled in the art.

Imaging processes include, for example, preparing an image with a xerographic device including a charging component, an imaging component, a photoconductive component, a developing component, a transfer component, and a fusing component. In embodiments, the development component may include a developer prepared by mixing a carrier with a toner composition described herein. The xerographic device may include a high speed printer, a black and white high speed printer, a color printer, and the like.

Once the image is formed with toners/developers via a suitable image development method such as any one of the aforementioned methods, the image may then be transferred to an image receiving medium such as paper and the like. In embodiments, the toners may be used in developing an image in an image-developing device utilizing a fuser roll member. Fuser roll members are contact fusing devices that are within the purview of those skilled in the art, in which heat and pressure from the roll may be used to fuse the toner to the image-receiving medium. In embodiments, the fuser member may be heated to a temperature above the fusing temperature of the toner, for example to temperatures of from about 70° C. to about 160° C., in embodiments from about 80° C. to about 150° C. in other embodiments from about 90° C. to about 140° C., after or during melting onto the image receiving substrate.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 25° C.

EXAMPLES

Comparative Example 1

About 397.99 grams of a linear amorphous resin in an emulsion (about 17.03 weight % resin) was added to a 2 liter beaker. The linear amorphous resin was of the following formula:

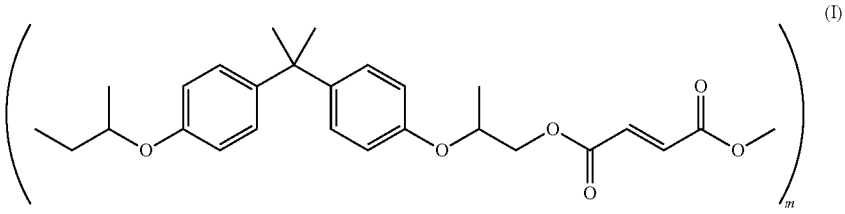

(I)

wherein m was from about 5 to about 1000 and was produced following the procedures described in U.S. Pat. No. 6,063,827, the disclosure of which is hereby incorporated by reference in its entirety. About 74.27 grains of an unsaturated crystalline polyester ("UCPE") resin composed of ethylene glycol and a mixture of dodecanedioic acid and fumaric acid co-monomers with the following formula:

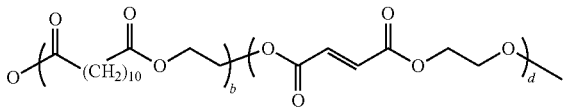

(II)

wherein b is from 5 to 2000 and d is from 5 to 2000 in an emulsion (about 19.98 weight % resin), synthesized following the procedures described in U.S. Patent Application Publication No. 2006/0222991, the disclosure of which is hereby incorporated by reference in its entirety, and about 29.24 grams of a cyan pigment, Pigment Blue 15:3, (about 17 weight %) was added to the beaker. About 36 grams of $Al_2(SO_4)_3$ (about 1 weight %) was added as flocculent under homogenization by mixing the mixture at about 3000 to 4000 rpm.

The mixture was subsequently transferred to a 2 liter Buchi reactor, and heated to about 45.9° C. for aggregation and mixed at a speed of about 750 rpm. The particle size was monitored with a COULTER COUNTER® until the size of the particles reached an average volume particle size of about 6.83 μm with a Geometric Size Distribution ("GSD") of about 1.21.

About 198.29 grams of the above emulsion with the resin of formula I was then added to the particles to form a shell thereover, resulting in particles possessing a core/shell structure with an average particle size of about 8.33 μm, and a GSD of about 1.21.

Thereafter, the pH of the reaction slurry was increased to about 6.7 by adding NaOH followed by the addition of about 0.45 pph EDTA (based on dry toner) to freeze, that is stop, the toner growth. After stopping the toner growth, the reaction mixture was heated to about 69° C. and kept at that temperature for about 1 hour for coalescence.

The resulting toner particles had a final average volume particle size of about 8.07, a GSD of about 1.22, and a circularity of about 0.976.

The toner slurry was then cooled to room temperature, separated by sieving (utilizing a 25 μm sieve) and filtered, followed by washing and freeze drying.

Example 1

Preparation of a polystyrene-acrylate-β-CEA gel latex. A latex emulsion including polymer gel particles generated from the semi-continuous emulsion polymerization of styrene, n-butyl acrylate, divinylbenzene, and β-CEA was prepared as follows. A surfactant solution including about 1.75 kilograms NEOGEN RK™ (a sodium dodecylbenzene sulfonate anionic surfactant) and about 145.8 kilograms of deionized water was prepared by mixing for about 10 minutes in a stainless steel holding tank. The holding tank was then purged with nitrogen for about 5 minutes before transferring into the reactor. The reactor was then continuously purged with nitrogen while being stirred at about 300 rpm. The reactor was then heated to about 76° C. at a controlled rate and held constant.

In a separate container, about 1.24 kilograms of ammonium persulfate initiator was dissolved in about 13.12 kilograms of de-ionized water.

A separate monomer emulsion was prepared in a second container as follows. About 47.39 kilograms of styrene, about 25.52 kilograms of NEOGEN RK™, and about 78.73 kilograms of deionized water were mixed to form an emulsion. The ratio of styrene monomer to n-butyl acrylate monomer by weight was about 65 percent to about 35 percent. About one percent of the above emulsion was then slowly fed into the reactor containing the aqueous surfactant phase at about 76° C. to form seed particles while the reactor was purged with nitrogen. The initiator solution was then slowly charged into the reactor; after about 20 minutes the rest of the emulsion was continuously fed into the reactor using metering pumps.

Once all the monomer emulsion was charged into the main reactor, the temperature was held at 76° C. for an additional 2 hours to complete the reaction. Cooling was then applied and the reactor temperature was reduced to about 35° C. The gel product was collected in a holding tank after filtration through a 1 micron filter bag.

After drying a portion of the gel latex, the molecular properties were measured to be Mw of about 134,700, Mn of about 27,300, and the onset Tg was about 43° C. The average particle size of the gel latex, as measured by a disc centrifuge, was about 48 nanometers, and the residual monomer content, as measured by gas chromatography (GC) was less than about 50 parts per million (ppm) for styrene and less than about 100 ppm for n-butyl acrylate.

Example 2

Preparation of toner particles having about 10% by weight of the gel from Example 1 in the toner core. About 312.99 grams of the linear amorphous resin of formula I from Comparative Example 1 above in an emulsion (about 17.8 weight % resin) was introduced into a 2 liter beaker. About 50.3 grams of the gel from Example 1 above in an emulsion (about 24.97 weight % resin), about 86.98 grams of the unsaturated CPE resin of formula II from Comparative Example 1 above in an emulsion (about 17.06 weight % resin), and about 29.24 grams of a cyan pigment, Pigment Blue 15:3, (about 17 weight %) was added to the beaker. About 36 grams of $Al_2(SO_4)_3$ (about 1 weight %) was added in as flocculent under homogenization by mixing the mixture at about 3000 to 4000 rpm.

The mixture was subsequently transferred to a 2 liter Buchi reactor, and heated to about 40° C. for aggregation and mixed at a speed of about 750 rpm. The particle size was monitored with a COULTER COUNTER® until the core particles reached a volume average particle size of about 6.83 μm with a GSD of about 1.30.

About 189.71 grams of the emulsion with the resin of formula I (about 17.8 weight % resin) was then added to the particles to form a shell thereover, resulting in particles possessing a core/shell structure with an average particle size of about 8.41 μm, and a GSD of about 1.23.

Thereafter, the pH of the reaction slurry was increased to about 6.4 by adding NaOH followed by the addition of about 0.45 pph EDTA (based on dry toner) to freeze, that is stop, the toner growth. After stopping the toner growth, the reaction mixture was heated to about 69° C. and kept at that temperature for about 1 hour for coalescence.

The resulting toner particles had a final average volume particle size of about 8.5 μm, a GSD of about 1.29.

The toner slurry was then cooled to room temperature, separated by sieving (utilizing a 25 μm sieve) and filtered, followed by washing and freeze drying.

Example 3

Preparation of toner particles having about 7.5% by weight of the gel from Example 1 in the toner core. The toner was prepared utilizing the same synthesis described in Example 2 above, with the amount of reactants as follows: about 402.57 grams of the linear amorphous resin of formula I from Comparative Example 1 above in an emulsion (about 17.01 weight % resin); about 44.13 grams of the gel from Example 1 above in an emulsion (about 24.97 weight % resin); about 96.72 grams of the unsaturated CPE resin of formula II from Comparative Example 1 above in an emulsion (about 17.9 weight % resin); about 34.11 grams of a cyan pigment, Pigment Blue 15:3, (about 17 weight %); and about 41.8 grams of $Al_2(SO_4)_3$ (about 1 weight %).

The components were combined and aggregated as described above in Example 2; particle size was monitored with a COULTER COUNTER® until the core particles reached a volume average particle size of about 6.83μm and a GSD of about 1.24.

About 231.61 grams of the emulsion with the resin of formula I was then added to the particles to form a shell thereover, resulting in particles possessing a core/shell structure with an average particle size of about 8.33 μm, and a GSD of about 1.21.

Coalescence proceeded as described above in Example 2 with the toner thus obtained having a final particle size of about 8.33 μm and a GSD of about 1.25.

Example 4

Preparation of toner particles having about 5% by weight of the gel from Example 1 in the toner core. The toner was prepared utilizing the same synthesis described in Example 2 above, with the amount of reactants as follows: about 362.99 grams of the linear amorphous resin of formula I from Comparative Example 1 above in an emulsion (about 17.8 weight % resin); about 25.15 grams of the gel from Example 1 above in an emulsion (about 24.97 weight % resin); about 86.98 grams of the unsaturated CPE resin of formula II from Comparative Example 1 above in an emulsion (about 17.06 weight % resin); about 29.24 grains of a cyan pigment, Pigment Blue 15:3, (about 17 weight %); and about 36 grams of $Al_2(SO_4)_3$ (about 1 weight %).

The components were combined, heated to about 43.5° C. and aggregated as described above in Example 2; particle size was monitored with a COULTER COUNTER® until the core particles reached a volume average particle size of about 7.12μm and a GSD of about 1.23.

About 189.71 grams of the emulsion with the resin of formula I was then added to the particles to form a shell thereover, resulting in particles possessing a core/shell structure with an average particle size of about 8.5 μm, and a GSD of about 1.23.

The pH of the reaction slurry was increased to about 7.1 using NaOH followed by the addition of about 0.45 pph of EDTA, and coalescence proceeded as described above in Example 2 with the toner thus obtained having a final particle size of about 8.07 μm and a GSD of about 1.23.

Example 5

Preparation of toner particles having about 5% by weight of the gel from Example 1 in the toner shell. About 398.5 grams of the linear amorphous resin of formula I from Comparative Example 1 above in an emulsion (about 17.01 weight % resin) was introduced into a 2 liter beaker. About 86.98 grains of the unsaturated CPE resin of formula II from Comparative Example 1 above in an emulsion (about 17.06 weight % resin), and about 29.24 grams of a cyan pigment, Pigment Blue 15:3, (about 17 weight %) was added to the beaker. About 36 grams of $Al_2(SO_4)_3$ (about 1 weight %) was added in as flocculent under homogenization by mixing the mixture at about 3000 to 4000 rpm.

The mixture was subsequently transferred to a 2 liter Buchi reactor, and heated to about 43.4° C. for aggregation and mixed at a speed of about 750 rpm. The particle size was monitored with a COULTER COUNTER® until the core particles reached a volume average particle size of about 6.83 μm with a GSD of about 1.24.

A mixture of about 25.14 grams of the of the gel resin in emulsion from Example 1 above (about 24.97 weight % resin) in combination with about 163.06 grams of the emulsion with the resin of formula I described above (about 17.01 weight % resin) was added to the particles to form a shell thereover, resulting in particles possessing a core/shell structure with an average particle size of about 8.41 μm, and a GSD of about 1.2.

Thereafter, the pH of the reaction slurry was increased to about 6.7 by adding NaOH followed by the addition of about 0.45 pph EDTA (based on dry toner) to freeze, that is stop, the toner growth. After stopping the toner growth, the reaction mixture was heated to about 69° C. and kept at that temperature for about 2 hours for coalescence.

The resulting toner particles had a final average volume particle size of about 8.59 μm, and a GSD of about 1.27.

The toner slurry was then cooled to room temperature, separated by sieving (utilizing a 25 μm sieve) and filtered, followed by washing and freeze drying.

Example 6

Preparation of toner particles having about 2.5% by weight of the gel from Example 1 in the toner core. The toner was prepared utilizing the same synthesis described in Example 2 above, with the amount of reactants as follows: about 380.53 grams of the linear amorphous resin of formula I from Comparative Example 1 above in an emulsion (about 17.03 weight % resin); about 12.72 grams of the gel from Example I above in an emulsion, (about 24.97 weight % resin); about 86.98 grams of the unsaturated CPE resin of formula II from Comparative Example 1 above in an emulsion (about 17.06 weight % resin); about 29.24 grams of a cyan pigment, Pigment Blue 15:3, (about 17 weight %); and about 36 grams of $Al_2(SO_4)_3$ (about 1 weight %).

The components were combined, heated to about 43.5° C. and aggregated as described above in Example 2; particle size was monitored with a COULTER COUNTER® until the core particles reached a volume average particle size of about 6.9 μm and a GSD of about 1.23.

About 198.52 grams of the emulsion with the resin of formula I was then added to the particles to form a shell thereover, resulting in particles possessing a core/shell structure with an average particle size of about 8.5 μm, and a GSD of about 1.21.

The pH of the reaction slurry was increased to about 6.7 using NaOH followed by the addition of about 0.45 pph of EDTA, and coalescence proceeded as described above in Example 2 with the toner thus obtained having a final particle size of about 7.5 μm and a GSD of about 1.27.

Example 7

Preparation of toner particles having about 2.5% by weight of the gel from Example 1 in the toner shell. The toner was prepared utilizing the same synthesis described in Example 5 above, with the amount of reactants for the core being identical to the core synthesized as described above in Example 5. The mixture was heated to 43.5° C. for aggregation, which proceeded as described above in Example 5 until the core particles reached a volume average particle size of about 6.83 μm with a GSD of about 1.24.

For the shell, about 12.57 grams of the of the gel resin in emulsion from Example 1 above (about 24.97 weight % resin) in combination with about 180.79 grams of the emulsion with the resin of formula I described above (about 17.01 weight % resin) was added to the particles to for a shell thereover, resulting in particles possessing a core/shell structure with an average particle size of about 8.77 μm, and a GSD of about 1.21.

Thereafter, the pH of the reaction slurry was increased to about 6.4 using NaOH followed by the addition of 0.45 pph EDTA with coalescence proceeding as described above in Example 5. The toner the toner thus obtained having a final particle size of about 8.33 μm and a GSD of about 1.24.

Rheological properties of the toner of Comparative Example 1 and the toners having gel in the core, that is, the toners of Examples 2, 3, 4 and 6, were determined by dynamic temperature step method using a dynamic stress rheometer SR 5000™ made by Maple Instruments Inc., following the manufacturer's instructions.

The results are set forth in FIG. 1. As can be seen in FIG. 1, the viscosity of the toners at higher temperatures (from about 130° C. to about 160° C.) increased as a function of the increase of gel latex loading. There was a significant difference in viscosity between the toner containing about 5% by weight gel latex in the core and the toner containing about 10% by weight of the gel latex in the core. The observed rheological difference was also observed in the fused image gloss performance as a function of fusing temperature.

The rheological properties of the toner having 5% gel in its core (Example 4) were compared with the toner having 5% gel in its shell (Example 5) by dynamic temperature step method using a dynamic stress rheometer SR 5000™, made by Maple Instruments Inc., following the manufacturer's instructions.

Figure 2A:
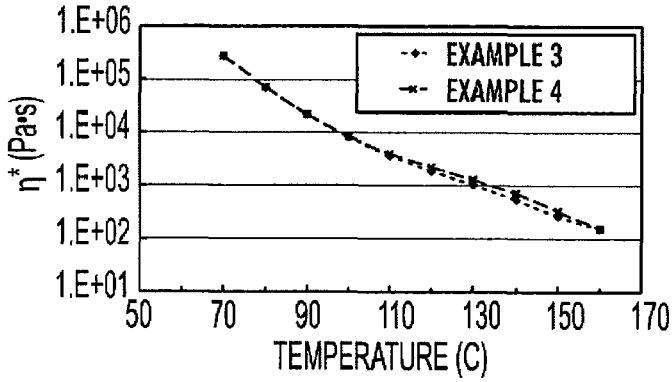
FIGS. 2*a* and 2*b* are graphs comparing the viscosity of the toner depending upon the location of the gel, either in the core or shell.
Figure 2B:
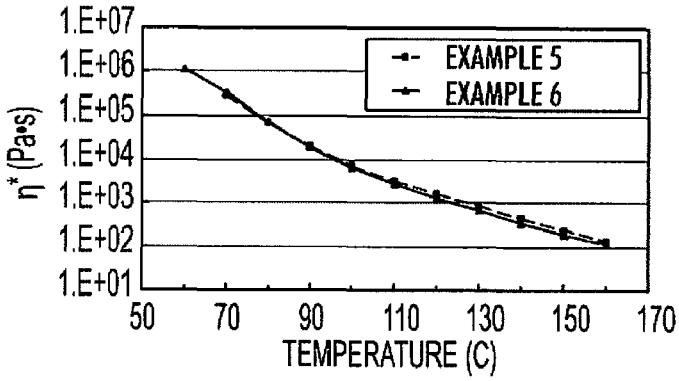

Similarly, the rheological properties of the toner having 2.5% gel in its core (Example 6) were compared with the toner having 2.5% gel in its shell (Example 7). The results for the toners of Examples 4 and 5 are set forth in FIG. 2*a*; the results for the toners of Examples 6 and 7 are set forth in FIG. 2*b*. As demonstrated in FIGS. 2*a* and 2*b*, the viscosity of the toner was influenced by the amount of gel latex loading; it did not matter whether the gel was located in the core of the toner particles or in the shell layer.

Fusing characteristics of the toners produced in Comparative Example 1 and the Examples were also determined by crease area, minimum fixing temperature, gloss, document offset, and vinyl offset testing.

Crease Area

The toner image displays mechanical properties such as crease, as determined by creasing a section of the substrate such as paper with a toned image thereon and quantifying the degree to which the toner in the crease separates from the paper. A good crease resistance may be considered a value of less than 1 mm, where the average width of the creased image is measured by printing an image on paper, followed by (a) folding inwards the printed area of the image, (b) passing over the folded image a standard TEFLON® coated copper roll weighing about 860 grams, (c) unfolding the paper and wiping the loose ink from the creased imaged surface with a cotton swab, and (d) measuring the average width of the ink free creased area with an image analyzer. The crease value can also be reported in terms of area, especially when the image is sufficiently hard to break unevenly on creasing; measured in terms of area, crease values of 100 millimeters correspond to about 1 mm in width. Further, the images exhibit fracture coefficients, for example of greater than unity. From the image analysis of the creased area, it is possible to determine whether the image shows a small single crack line or is more brittle and easily cracked. A single crack line in the creased area provides a fracture coefficient of unity while a highly cracked crease exhibits a fracture coefficient of greater than unity. The greater the cracking, the greater the fracture coefficient. Toners exhibiting acceptable mechanical properties, which are suitable for office documents, may be obtained by utilizing the aforementioned thermoplastic resins. However, there is also a need for digital xerographic applications for flexible packaging on various substrates. For flexible packaging applications, the toner materials must meet very demanding requirements such as being able to withstand the high temperature conditions to which they are exposed in the packaging process and enabling hot pressure-resistance of the images. Other applications, such as books and manuals, require that the image does not document offset onto the adjacent image. These additional requirements require alternate resin systems, for example that provide thermoset properties such that a crosslinked resin results after fusing or post-fusing on the toner image.

Minimum Fixing Temperature

The Minimum Fixing Temperature (MFT) measurement involves folding an image on paper fused at a specific temperature, and rolling a standard weight across the fold. The print can also be folded using a commercially available folder such as the Duplo D-590 paper folder. The folded image is then unfolded and analyzed under the microscope and assessed a numerical grade based on the amount of crease showing in the fold. This procedure is repeated at various temperatures until the minimum fusing temperature (showing very little crease) is obtained.

Gloss

Print gloss (Gardner gloss units or "ggu") was measured using a 75° BYK Gardner gloss meter for toner images that had been fused at a fuser roll temperature range of about 120° C. to about 210° C. (sample gloss was dependent on the toner, the toner mass per unit area, the paper substrate, the fuser roll, and fuser roll temperature).

Document Offset

A standard document offset mapping procedure was performed as follows. Five centimeter (cm) by five cm test samples were cut from the prints taking care that when the sheets are placed face to face, they provide both toner to toner and toner to paper contact. A sandwich of toner to toner and toner to paper was placed on a clean glass plate. A glass slide was placed on the top of the samples and then a weight comprising a 2000 gram mass was placed on top of the glass slide. The glass plate was then inserted into an environmental chamber at a temperature of 60° C. where the relative humidity was kept constant at 50%. After 7 days, the samples were removed from the chamber and allowed to cool to room temperature before the weight was removed. The removed samples were then carefully peeled apart. The peeled samples were mounted onto a sample sheet and then visually rated with a Document Offset Grade from 5.0 to 1.0, wherein a lower grade indicates progressively more toner offset, ranging from none (5.0) to severe (1.0). Grade 5.0 indicates no toner offset and no adhesion of one sheet to the other. Grade 4.5 indicates noticeable adhesion, but no toner offset. Grade 4 indicates that a very small amount of toner offsets to the other sheet. Grade 3 indicates that less than ⅓ of the toner image offsets to the other sheet, while Grade 1.0 indicates that more than ½ of the toner image offsets to the other sheet. In general, an evaluation of greater than or equal to 3.0 is considered the minimum acceptable offset, and an evaluation of greater than or equal to 4.0 is desirable.

Vinyl Offset

Vinyl offset was evaluated as follows. Toner images were covered with a piece of standard vinyl (32% dioctyl phthalate Plasticizer), placed between glass plates, loaded with a 250 gram weight, and placed in an environmental oven at a pressure of 10 g/cm$^2$, 50° C. and 50% relative humidity (RH). After about 24 hours, the samples were removed from the oven and allowed to cool to room temperature. The vinyl and toner image were carefully peeled apart, and evaluated with reference to a vinyl offset evaluation rating procedure as described above for document offset wherein Grades 5.0 to 1.0 indicate progressively higher amounts of toner offset onto the vinyl, from none (5.0) to severe (1.0). Grade 5.0 indicates no visible toner offset onto the vinyl and no disruption of the image gloss. Grade 4.5 indicates no toner offset, but some disruption of image gloss. An evaluation of greater than or equal to 4.0 is considered an acceptable grade.

The results of these fusing tests are summarized below in Table 1.

TABLE 1

| | Goal | Comparative Example 1 | Example 5 | Example 6 | Example 3 | Example 4 | Example 2 | Example 1 |
|---|---|---|---|---|---|---|---|---|
| DCX+ (90 gsm) paper | | | | | | | | |
| Cold Offset | | 113 | 126 | 126 | 126 | 130 | 126 | 126 |
| Hot Offset | | >210 | >210 | >210 | >210 | >210 | >210 | >210 |
| $T_{G40}$ | ≦175° C. | 142 | 146 | 146 | 154 | 156 | 161 | 185 |
| Gloss @ MFT | 40 ggu | 38.0 | 29.5 | 38.2 | 30.0 | 36.6 | 24.9 | 18.0 |
| Gloss @ 185° C. | ≧40 | 72.5 | 66.6 | 70.3 | 65.3 | 54.7 | 49.4 | 39.9 |
| Peak Gloss | ≧50 | 72.6 | 66.6 | 71.1 | 68.3 | 60.1 | 51.0 | 46.9 |
| $MFT_{CA\ 85}$ | ≦169° C. | 140 | 140 | 144 | 146 | 153 | 140 | 136 |
| $\Delta MFT_{CA\ 85}$ | | −34 | −39 | −26 | −33 | −26 | −36 | −34 |
| MFT/ΔMFT | Gloss 40 & CA = 85 | 142/−34 | 146/−34 | 146/−33 | 154/−26 | 156/−24 | 161/−15 | 185/+6 |
| $FC_{CA\text{-}85}$ | | 4.34 | 3.92 | 4.13 | 4.08 | 4.31 | 4.10 | 3.72 |
| Document Offset (Toner-Toner) SIR (rmsLA) | ≧iGen3 Ideally 4 | 1.00 (15.1) | 1.00 (5.8) | 1.00 (10.4) | 1.00 (20.1) | 1.00 (13.0) | 1.00 (12.5) | 1.50 (1.52) |

TABLE 1-continued

| | Goal | Comparative Example 1 | Example 5 | Example 6 | Example 3 | Example 4 | Example 2 | Example 1 |
|---|---|---|---|---|---|---|---|---|
| Document Offset (Toner-Paper) SIR (% toner) | ≧iGen3 Ideally 4 | 1.00 (12.5) | 1.00 (8.4) | 1.00 (9.9) | 1.00 (23.6) | 1.00 (13.1) | 1.00 (11.3) | 1.25 (2.57) |
| Vinyl Offset SIR (% toner) DCEG (120 gsm) paper | ≧4 FX vinyl | N/A | N/A | N/A | N/A | N/A | N/A | N/A |
| $T_{G40}$ | ≦175° C. | 141 | 146 | 148 | 153 | 159 | 155 | 173 |
| Gloss @ MFT | 40 ggu | 31.5 | 25.3 | 33.2 | 34.6 | 31.7 | 28.9 | 7.9 |
| Gloss @ 185° C. | ≧40 | 80.2 | 88.5 | 87.8 | 76.8 | 67.7 | 63.6 | 46.8 |
| Peak Gloss | ≧50 | 94.1 | 93.4 | 95.8 | 91.2 | 83.2 | 73.7 | 62.9 |
| $MFT_{CA\ 85}$ | ≦169° C. | 137 | 139 | 144 | 143 | 149 | 145 | 139 |
| $\Delta MFT_{CA\ 85}$ | | −34 | −43 | −30 | −39 | −33 | −37 | −35 |

Figure 3:
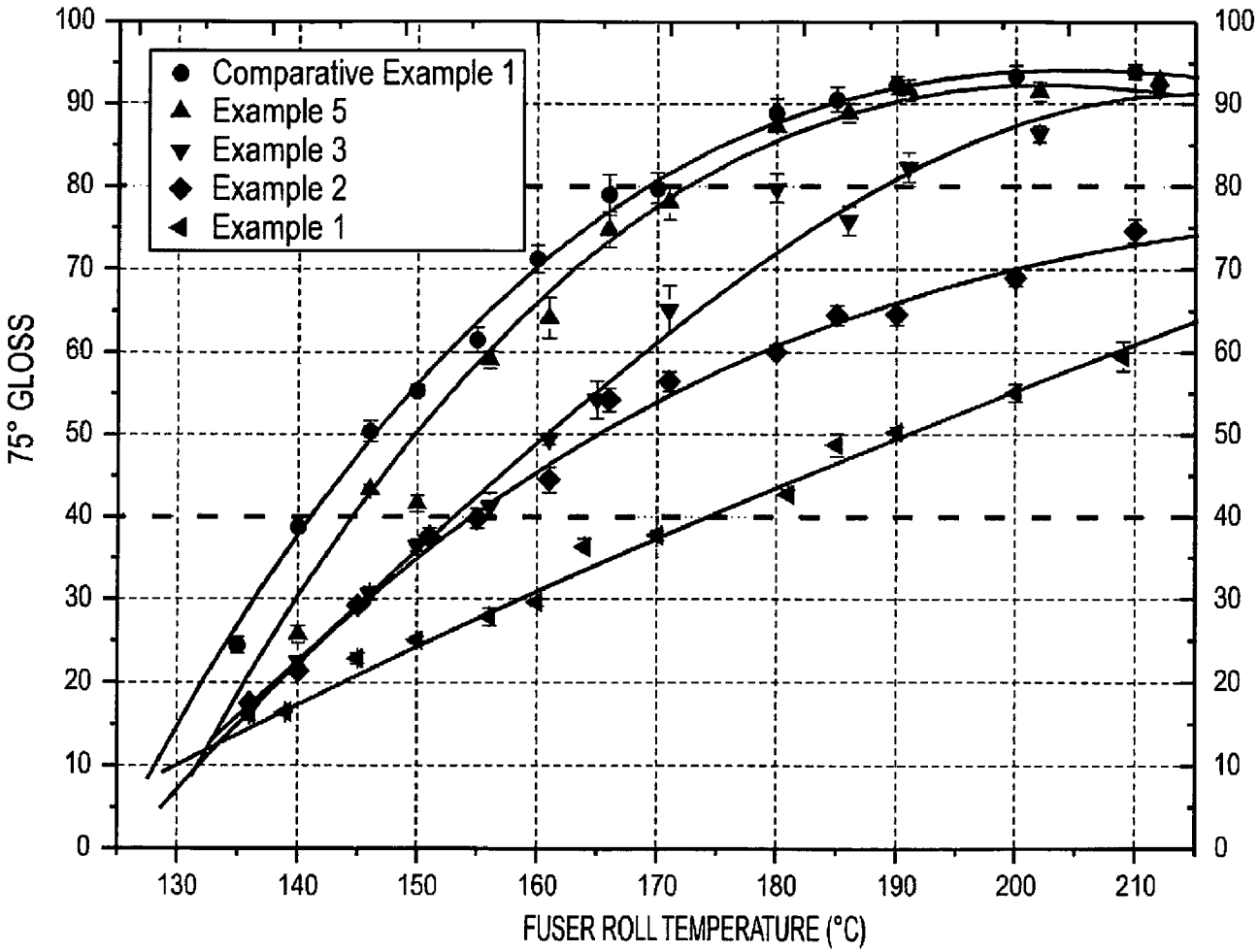
FIG. 3 is a graph depicting gloss values obtained for toners of the present disclosure produced in the Examples compared with the toner of Comparative Example 1.

MFT = Minimum fixing temperature (minimum temperature at which acceptable adhesion of the toner to the support medium occurs)
DCX = Uncoated Xerox paper
DCEG = Coated Xerox paper
gsm = grams per square meter
CA = crease area
$T_{G40}$ = Fusing temperature to reach 40 gloss unit As can be seen from the results set forth above in Table 1, viscosity of the toner was an important factor in fusing performance. At 2.5% gel latex loading in either the core or the shell (Examples 6 and 7, respectively), the peak gloss did not drop, indicating that the loading was not high enough. Example 5, with 5% gel in the shell layer, produced a drop in peak gloss from 93 ggu to 83 ggu (see also FIG. 3). The crease fix MFT increased with about 5% gel in the shell layer, from about 146° C. to about 153° C., which was within the latitude range for crease fix MFT. The MFT relative to the control was within the target range.

Figure 4:
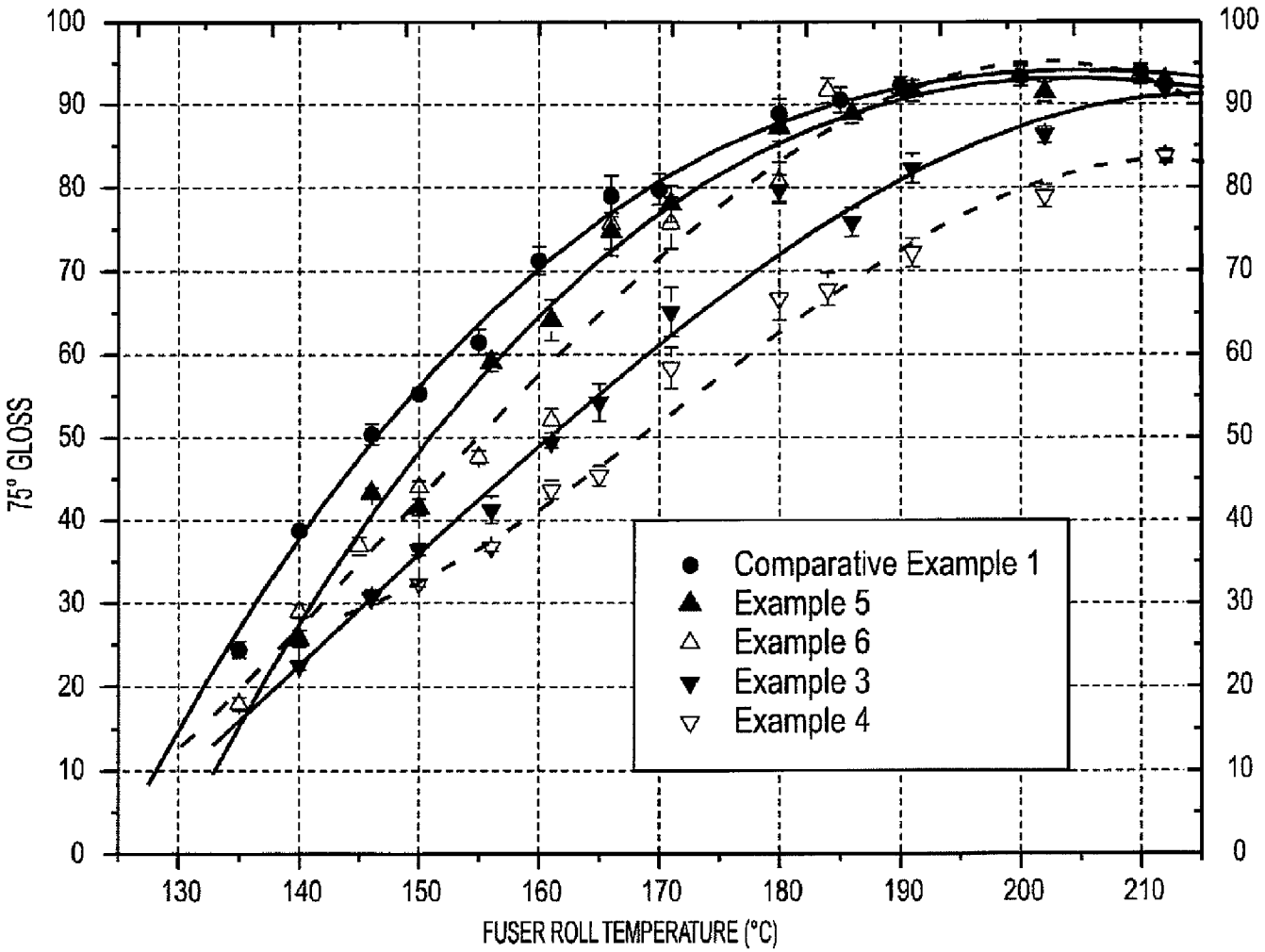
FIG. 4 is a graph depicting gloss values obtained for toners of the present disclosure produced in the Examples compared with the toner of Comparative Example 1.

The gel in the shell also resulted in a slightly larger shift of the gloss curve. While higher levels of gel in the shell layer may reduce peak gloss further, it may also further increase the crease fix MFT. Further additions of gel in the core were examined which shifted the gloss curves to higher temperatures while also reducing the peak gloss as indicated in FIG. 4.

Figure 5:
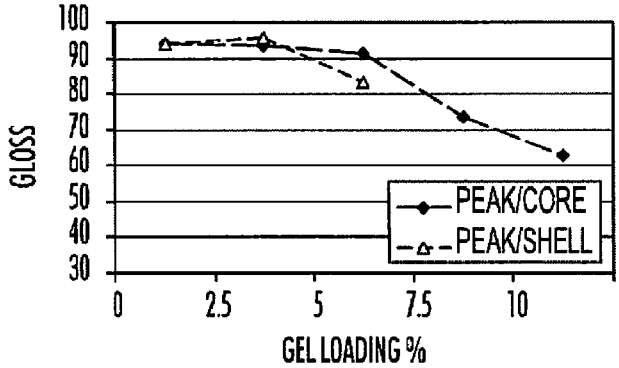
FIG. 5 is a graph demonstrating the effects of gel loading on gloss for toners of the present disclosure, including whether the gel was in the core or the shell.

Peak gloss measurements are also set forth in FIG. 5, which is a graph showing peak gloss as a function of gel loading in the core and in the shell. As can be seen in FIG. 5, the peak gloss decreased with increased gel loading, and the gloss could be reduced significantly with even small amounts of gel loading. Upon comparing a toner with gel in its shell with a toner having gel in its core, the addition of gel in the shell was observed to be more effective in reducing gloss.

Figure 6A:
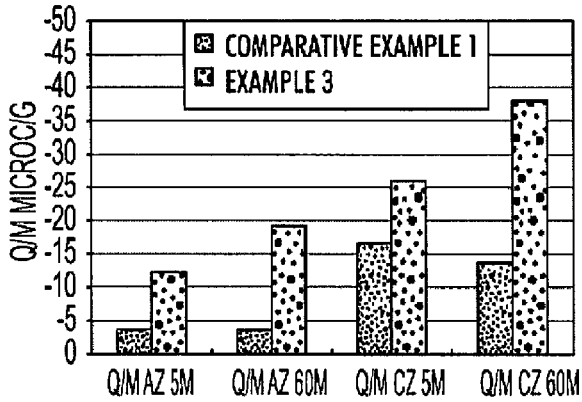
FIGS. 6*a*, 6*b* and 6*c* are graphs comparing the charging (in both A-zone and C-zone) of toners of the present disclosure with a control toner.
Figure 6B:
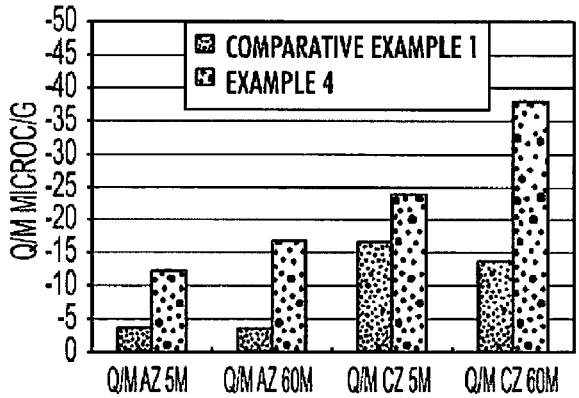
Figure 6C:
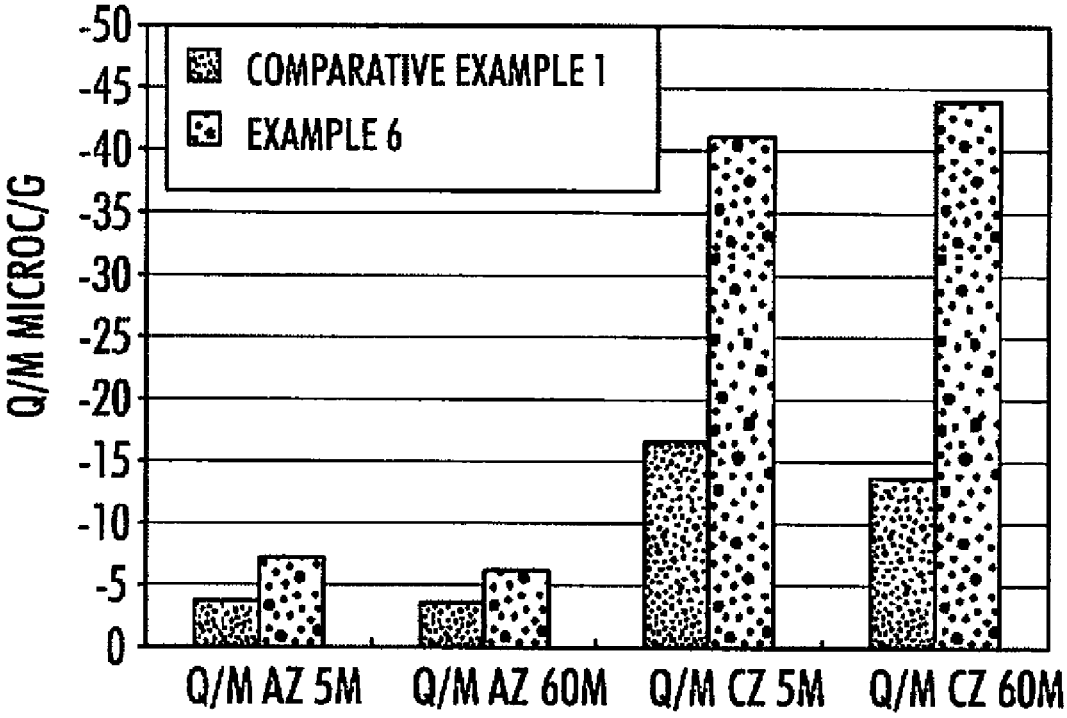

Charge data was also obtained for the toners. The results are set forth in FIG. 6, which includes plots comparing the charging between the toners of the present disclosure with 5% gel in the core (FIG. 6*a*), 5% gel in the shell (FIG. 6*b*), 2.5% gel in the shell (FIG. 6*c*) and the comparative toner (Comparative Example 1) at both the A-zone and C-zone. As can be seen in FIGS. 6*a*, 6*b*, and 6*c*, the addition of the styrene-acrylate gel increased toner charging in the A-zone and C-zone compared to the toner of Comparative Example 1, which did not contain a gel.

The location of the gel, either in the core or in the shell, did not change the charge performance of the toners. When the gel latex loadings increased from 2.5% to 5%, the A-zone charging of the toner of the present disclosure increased remarkably, regardless of location (i.e., core or shell). This indicated that the toner with only 5% gel loading was much less sensitive to relative humidity (RH) than the toner of Comparative Example 1. While not wishing to be bound by any theory, it is believed the improvement in charging was because the gel prevented the crystalline polyester resin in the core from migrating to the toner surface, which decreased A-Zone charging.

It was also observed that the addition of the gel decreased particle to particle cohesion; with more gel in the toner, there was less particle to particle cohesion. Placing the gel in the shell was more efficient in improving toner cohesion than placing the gel in the core.

Thus, to summarize, peak gloss of the toners of the present disclosure was reduced significantly and A-zone charging was improved dramatically, while maintaining ultra low melt properties. Interestingly, it was found that the gloss and charging levels could be controlled by controlling the gel loading and/or the location (e.g. core or shell) of the gel without detrimental effects on the other fusing properties of the toner. It was also found that the incorporation of the styrene-acrylate gel improved cohesion of the toners.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A toner comprising:

at least one amorphous polyester resin, at least one crystalline polyester resin, and one or more optional ingredients selected from the group consisting of colorants, optional waxes, and combinations thereof; and a gel comprising a crosslinked polymer comprising copolymers of styrene and acrylates, copolymers of styrene and butadiene, copolymers of styrene and methacrylates, copolymers of acrylates and methacrylates, copolymers of methacrylates and acrylic acid, copolymers of acrylates and acrylonitriles, copolymers of methylstyrene and butadiene, copolymers of acrylates and butadiene, copolymers of styrene and isoprene, copolymers of methylstyrene and isoprene, copolymers of methacrylates and isoprene, copolymers of acrylates and isoprene, or combinations thereof, wherein the toner particles have a volume average diameter of about 3 μm to about 25 μm, possess a circularity of from about 0.93 to about 0.98, possess a triboelectric charge per mass ratio of from about −3 μC/g to about −35 μC/g, and possess a gloss of from about 20 ggu to about 100 ggu.

2. The toner according to claim 1, wherein the at least one amorphous resin comprises a polyester selected from the group consisting of poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof, and wherein the at least one crystalline resin comprises a polyester selected from the group consisting of poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), polypropylene-sebacate), poly(butylene-sebacate), poly(pentylene-sebacate), poly(hexylene-sebacate), poly(octylene-sebacate), alkali copoly(5-sulfoisophthaloyl)-copoly(ethylene-adipate), alkali copoly(5-sulfoisophthaloyl)-copoly(propylene-adipate), alkali copoly(5-sulfoisophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfoisophthaloyl)-copoly(ethylene-succinate), alkali copoly(5-sulfoisophthaloyl)-copoly(propylene-succinate), alkali copoly(5-sulfoisophthaloyl)-copoly(butylene-succinate), alkali copoly(5-sulfoisophthaloyl)-copoly(pentylene-succinate), alkali copoly(5-sulfoisophthaloyl)-copoly(hexylene-succinate), alkali copoly(5-sulfoisophthaloyl)-copoly(octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly(hexylene-sebacate), and alkali copoly(5-sulfo-isophthaloyl)-copoly(octylene-sebacate), wherein alkali comprises a metal selected from the group consisting of sodium, lithium and potassium.

3. The toner according to claim 1, wherein the toner particles comprise a core with a shell thereover, and wherein the gel is present in the core in an amount of from about 2.5% to about 10% by weight of the toner.

4. The toner according to claim 1, wherein the toner particles comprise a core with a shell thereover, and wherein the gel is present in the shell in an amount of from about 2.5% to about 10% by weight of the toner.

5. The toner according to claim 1, wherein the toner particles comprise a core with a shell thereover, and wherein the gel is present in both the core and the shell.

6. The toner according to claim 1, wherein the copolymer is selected from the group consisting of poly(styrene-co-alkyl acrylate), poly(styrene-co-butadiene), poly(styrene-co-alkyl methacrylate), polystyrene-co-alkyl acrylate-co-acrylic acid), poly(styrene-co-1,3-butadiene-co-acrylic acid), poly(styrene-co-alkyl methacrylate-co-acrylic acid), poly(alkyl methacrylate-co-alkyl acrylate), poly(alkyl methacrylate-co-aryl acrylate), poly(aryl methacrylate-co-alkyl acrylate), poly(alkyl methacrylate-co-acrylic acid), poly(styrene-co-alkyl acrylate-co-acrylonitrile-acrylic acid), poly(styrene-co-butadiene-co-acrylonitrile-co-acrylic acid), poly(alkyl acrylate-co-acrylonitrile-co-acrylic acid), poly(methyl acrylate-co-butadiene), poly(ethyl acrylate-co-butadiene), poly(propyl acrylate-co-butadiene), poly(butyl acrylate-co-butadiene), poly(styrene-co-isoprene), poly(Methylstyrene-co-isoprene), poly(methyl methacrylate-co-isoprene), poly(ethyl methacrylate-co-isoprene), poly(propyl methacrylate-co-isoprene), poly(butyl methacrylate-co-isoprene), poly(methyl acrylate-co-isoprene), poly(ethyl acrylate-co-isoprene), poly(propyl acrylate-co-isoprene), poly(butyl acrylate-co-isoprene), poly(styrene-co-propyl acrylate), poly(styrene-co-butyl acrylate), poly(styrene-co-butadiene-co-methacrylic acid), poly(styrene-co-butyl acrylate-co-acrylic acid), poly(styrene-co-butyl acrylate-co-methacrylic acid), poly(styrene-co-butyl acrylate-co-acrylonitrile), poly(styrene-co-butyl acrylate-co-acrylonitrile-acrylic acid), poly(styrene-co-butyl methacrylate), poly(styrene-co-butyl methacrylate-co-acrylic acid), poly(butyl methacrylate-co-butyl acrylate), poly(butyl methacrylate-co-acrylic acid), poly(acrylonitrile-co-butyl acrylate-co-acrylic acid), and combinations thereof.

7. The toner according to claim 1, wherein the crosslinked polymer comprises a stabilizer containing a carboxylic acid group or a carboxylic acid salt group.

8. The toner according to claim 1, wherein the crosslinked polymer comprises a stabilizer possessing a carboxylic acid functionality of the formula:

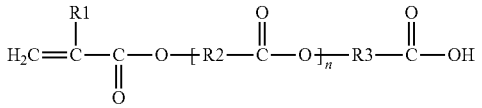

(III)

where R1 is hydrogen or a methyl group; R2 and R3 are independently selected from alkyl groups containing from about 1 to about 12 carbon atoms or a phenyl group; and n is from about 0 to about 20.

9. The toner according to claim 8, wherein the at least one amorphous resin comprises a poly(propoxylated bisphenol A co-fumarate) resin of the formula:

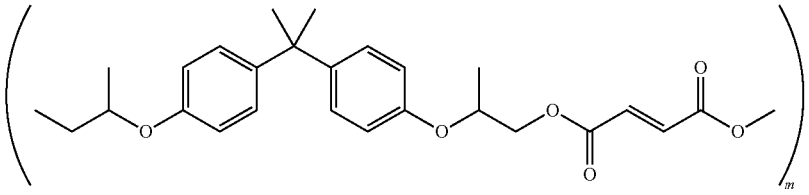

(I)

wherein m may be from about 5 to about 1000, wherein the at least one crystalline resin is of the formula:

(II)

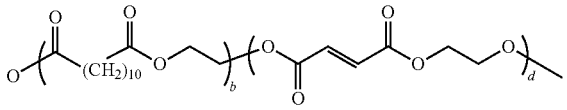

wherein b is from 5 to 2000 and d is from 5 to 2000, and wherein the stabilizer comprises beta-carboxyethyl acrylate.

10. The toner according to claim 1, wherein from about 1% by weight to about 100% by weight of the gel is crosslinked, and wherein the gel is present in an amount of from about 1% to about 30% by weight of the toner.

11. A toner comprising: at least one amorphous polyester resin, at least one crystalline polyester resin, and one or more optional ingredients selected from the group consisting of colorants, optional waxes, and combinations thereof; and a gel comprising a crosslinked polymer comprising copolymers of styrene and acrylates, copolymers of styrene and butadiene, copolymers of styrene and methacrylates, copolymers of acrylates and methacrylates, copolymers of methacrylates and acrylic acid, copolymers of acrylates and acrylonitriles, copolymers of methylstyrene and butadiene, copolymers of methacrylates and butadiene, copolymers of acrylates and butadiene, copolymers of styrene and isoprene, copolymers of methylstyrene and isoprene, copolymers of methacrylates and isoprene, copolymers of acrylates and isoprene, or combinations thereof, wherein the crosslinked polymer comprises a stabilizer possessing a carboxylic acid functionality derived from a co-monomer of the formula:

(III)

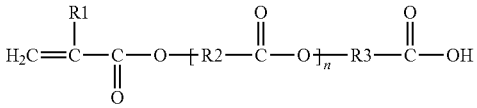

where R1 is hydrogen or a methyl group; R2 and R3 are independently selected from alkyl groups containing from about 1 to about 12 carbon atoms or a phenyl group; and n is from about 0 to about 20, and wherein the toner particles have a volume average diameter of about 3 μm to about 25 μm, possess a circularity of from about 0.93 to about 0.98, possess a triboelectric charge per mass ratio of from about −3 μC/g to about −35 μC/g, and possess a gloss of from about 20 ggu to about 100 ggu.

12. The toner according to claim 11, wherein the at least one amorphous resin comprises a polyester selected from the group consisting of poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), polypropoxylated bisphenol co-itaconate), poly (ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof, and the at least one crystalline resin comprises a polyester selected from the group consisting of poly(ethylene-adipate), polypropylene-adipate), poly(butylene-adipate), poly(pentylene-adipate), poly (hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), alkali copoly(5-sulfoisophthaloyl)-copoly(ethylene-adipate), alkali copoly (5-sulfoisophthaloyl)-copoly(propylene-adipate), alkali copoly(5-sulfoisophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfoisophthaloyl)-copoly (ethylene-succinate), alkali copoly(5-sulfoisophthaloyl)-copoly(propylene-succinate), alkali copoly(5-sulfoisophthaloyl)-copoly(butylene-succinate), alkali copoly (5-sulfoisophthaloyl)-copoly(pentylene-succinate), alkali copoly(5-sulfoisophthaloyl)-copoly(hexylene-succinate), alkali copoly(5-sulfoisophthaloyl)-copoly(octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfoisophthaloyl)-copoly (butylene-sebacate), alkali copoly(5-sulfo-isophthaloyl)-copoly(pentylene-sebacate), alkali copoly(5-sulfo-isophthaloyl)-copoly(hexylene-sebacate), and alkali copoly (5-sulfo-isophthaloyl)-copoly(octylene-sebacate), wherein alkali comprises a metal selected from the group consisting of sodium, lithium and potassium.

13. The toner according to claim 11, wherein the toner particles comprise a core with a shell thereover, and wherein the gel is present in the core, the shell, or both.

14. The toner according to claim 11, wherein the copolymer is selected from the group consisting of poly(styrene-co-alkyl acrylate), poly(styrene-co-butadiene), poly(styrene-co-alkyl methacrylate), poly(styrene-co-alkyl acrylate-co-acrylic acid), poly(styrene-co-1,3-butadiene-co-acrylic acid), poly(styrene-co-alkyl methacrylate-co-acrylic acid), poly(alkyl methacrylate-co-alkyl acrylate), poly(alkyl methacrylate-co-aryl acrylate), poly(aryl methacrylate-co-alkyl acrylate), poly(alkyl methacrylate-co-acrylic acid), poly(styrene-co-alkyl acrylate-co-acrylonitrile-acrylic acid), poly (styrene-co-butadiene-co-acrylonitrile-co-acrylic acid), poly (alkyl acrylate-co-acrylonitrile-co-acrylic acid), poly (methylstyrene-co-butadiene), poly(methyl methacrylate-co-butadiene), poly(ethyl methacrylate-co-butadiene), poly (propyl methacrylate-co-butadiene), poly(butyl methacrylate-co-butadiene), poly(methylacrylate-co-butadiene), poly(ethyl acrylate-co-butadiene), poly(propyl acrylate-co-butadiene), poly(butyl acrylate-co-butadiene), poly (styrene-co-isoprene), poly(methylstyrene-co-isoprene), poly(methyl methacrylate-co-isoprene), poly(ethyl methacrylate-co-isoprene), poly(propyl methacrylate-co-isoprene), poly(butyl methacrylate-co-isoprene), poly(methyl acrylate-co-isoprene), poly(ethyl acrylate-co-isoprene), poly (propyl acrylate-co-isoprene), poly(butyl acrylate-co-isoprene), poly(styrene-co-propyl acrylate), poly(styrene-co-butyl acrylate), poly(styrene-co-butadiene-co-methacrylic acid), poly(styrene-co-butyl acrylate-co-acrylic acid), poly (styrene-co-butyl acrylate-co-methacrylic acid), poly(styrene-co-butyl acrylate-co-acrylonitrile), poly(styrene-co-butyl acrylate-co-acrylonitrile-acrylic acid), poly(styrene-co-butyl methacrylate), poly(styrene-co-butyl methacrylate-co-acrylic acid), poly(butyl methacrylate-co-butyl acrylate), poly(butyl methacrylate-co-acrylic acid), poly(acrylonitrile-co-butyl acrylate-co-acrylic acid), and combinations thereof.

15. The toner according to claim 11, wherein the at least one amorphous resin comprises a poly(propoxylated bisphenol A co-fumarate) resin of the formula:

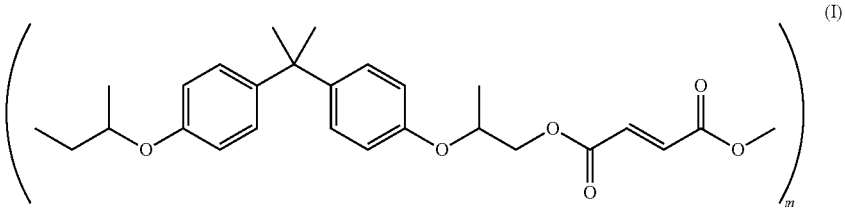

(I)

wherein m may be from about 5 to about 1000, wherein the at least one crystalline resin is of the formula:

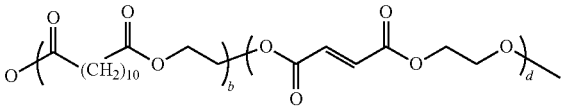

(II)

wherein b is from 5 to 2000 and d is from 5 to 2000, and wherein the stabilizer comprises a beta-carboxyethyl acrylate.

16. The toner according to claim 11, wherein from about 1% by weight to about 100% by weight of the gel is crosslinked, wherein the gel is present in an amount of from about 1% to about 30% by weight of the toner.

17. A process comprising: contacting at least one amorphous polyester resin with at least one crystalline polyester resin in an emulsion comprising at least one surfactant; contacting the emulsion with an optional colorant, and an optional wax; contacting the emulsion with a gel comprising a crosslinked polymer comprising copolymers of styrene and acrylates, copolymers of styrene and butadiene, copolymers of styrene and methacrylates, copolymers of acrylates and methacrylates, copolymers of methacrylates and acrylic acid, copolymers of acrylates and acrylonitriles, copolymers of methylstyrene and butadiene, copolymers of methacrylates and butadiene, copolymers of acrylates and butadiene, copolymers of styrene and isoprene, copolymers of methylstyrene and isoprene, copolymers of methacrylates and isoprene, copolymers of acrylates and isoprene, or combinations thereof to form small particles; aggregating the small particles to form a plurality of larger aggregates; coalescing the larger aggregates to form particles; and recovering the particles, wherein the toner particles have a volume average diameter of about 3 μm to about 25 μm, possess a circularity of from about 0.93 to about 0.98, possess a triboelectric charge per mass ratio of from about −3 μC/g to about −35 μC/g, and possess a gloss of from about 20 ggu to about 100 ggu.

18. The process according to claim 17, wherein the at least one amorphous resin comprises a polyester selected from the group consisting of poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof, and the at least one crystalline resin comprises a polyester selected from the group consisting of poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), alkali copoly(5-sulfoisophthaloyl)-copoly(ethylene-adipate), alkali copoly(5-sulfoisophthaloyl)-copoly(propylene-adipate), alkali copoly(5-sulfoisophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate),-alkali copoly(5-sulfoisophthaloyl)-copoly(ethylene-succinate), alkali copoly(5-sulfoisophthaloyl)-copoly(propylene-succinate), alkali copoly(5-sulfoisophthaloyl)-copoly(butylene-succinate), alkali copoly(5-sulfoisophthaloyl)-copoly(pentylene-succinate), alkali copoly(5-sulfoisophthaloyl)-copoly(hexylene-succinate), alkali copoly(5-sulfoisophthaloyl)-copoly(octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly(hexylene-sebacate), and alkali copoly(5-sulfo-isophthaloyl)-copoly(octylene-sebacate), and wherein alkali comprises a metal selected from the group consisting of sodium, lithium and potassium.

19. The process according to claim 17, wherein the copolymer is selected from the group consisting of poly(styrene-co-alkyl acrylate), poly(styrene-co-butadiene), poly(styrene-co-alkyl methacrylate), poly(styrene-co-alkyl acrylate-co-acrylic acid), poly(styrene-co-1,3-butadiene-co-acrylic acid), poly(styrene-co-alkyl methacrylate-co-acrylic acid), poly(alkyl methacrylate-co-alkyl acrylate), poly(alkyl methacrylate-co-aryl acrylate), poly(aryl methacrylate-co-alkyl acrylate), poly(alkyl methacrylate-co-acrylic acid), poly(styrene-co-alkyl acrylate-co-acrylonitrile-acrylic acid), poly(styrene-co-butadiene-co-acrylonitrile-co-acrylic acid), poly(alkyl acrylate-co-acrylonitrile-co-acrylic acid), poly(methylstyrene-co-butadiene), poly(methyl methacrylate-co-butadiene), poly(ethyl methacrylate-co-butadiene), poly(propyl methacrylate-co-butadiene), poly(butyl methacrylate-co-butadiene), poly(methyl acrylate-co-butadiene), poly(ethyl acrylate-co-butadiene), poly(propyl acrylate-co-butadiene), poly(butyl acrylate-co-butadiene), poly (styrene-co-isoprene), poly(methylstyrene-co-isoprene), poly(methyl methacrylate-co-isoprene), poly(ethyl methacrylate-co-isoprene), poly(propyl methacrylate-co-isoprene), poly(butyl methacrylate-co-isoprene), poly(methyl acrylate-co-isoprene), poly(ethyl acrylate-co-isoprene), poly (propyl acrylate-co-isoprene), poly(butyl acrylate-co-isoprene), poly(styrene-co-propyl acrylate), poly(styrene-co-butyl acrylate), poly(styrene-co-butadiene-co-methacrylic acid), poly(styrene-co-butyl acrylate-co-acrylic acid), poly (styrene-co-butyl acrylate-co-methacrylic acid), poly(styrene-co-butyl acrylate-co-acrylonitrile), poly(styrene-co-butyl acrylate-co- acrylonitrile-acrylic acid), poly(styrene-co-butyl methacrylate), poly(styrene-co-butyl methacrylate-co-acrylic acid), poly(butyl methacrylate-co-butyl acrylate), poly(butyl methacrylate-co-acrylic acid), poly(acrylonitrile-co-butyl acrylate-co-acrylic acid), and combinations thereof, and wherein from about 1% by weight to about 100% by weight of the gel is crosslinked.

* * * * *